US010486948B2

(12) United States Patent
Kosuga et al.

(10) Patent No.: US 10,486,948 B2
(45) Date of Patent: Nov. 26, 2019

(54) ROPE HOIST

(71) Applicant: KITO CORPORATION, Nakakoma-gun, Yamanashi (JP)

(72) Inventors: Kosuke Kosuga, Yamanashi (JP); Fujito Yudate, Yamanashi (JP)

(73) Assignee: KITO CORPORATION, Nakakoma-Gun, Yamanashi (JP)

( * ) Notice: Subject to any disclaimer, the term of this patent is extended or adjusted under 35 U.S.C. 154(b) by 126 days.

(21) Appl. No.: 15/570,830

(22) PCT Filed: Mar. 16, 2016

(86) PCT No.: PCT/JP2016/058405
§ 371 (c)(1),
(2) Date: Oct. 31, 2017

(87) PCT Pub. No.: WO2016/178339
PCT Pub. Date: Nov. 10, 2016

(65) Prior Publication Data

US 2018/0346295 A1 Dec. 6, 2018

(30) Foreign Application Priority Data

May 1, 2015 (JP) ..... 2015-094012

(51) Int. Cl.
*B66D 1/30* (2006.01)
*B66D 1/28* (2006.01)
(Continued)

(52) U.S. Cl.
CPC ..... *B66D 1/30* (2013.01); *B66C 11/04* (2013.01); *B66C 13/50* (2013.01); *B66D 1/12* (2013.01);
(Continued)

(58) Field of Classification Search
CPC ... B66D 1/30; B66D 1/12; B66D 1/22; B66D 1/28; B66D 1/38; B66D 1/56; B66D 3/08;
(Continued)

(56) References Cited

U.S. PATENT DOCUMENTS 5,947,450 A * 9/1999 Grapes ..... B66D 1/28 242/398
8,763,992 B2 7/2014 Imbusch et al.
(Continued)

FOREIGN PATENT DOCUMENTS

CN 2181494 Y 11/1994
CN 200958018 Y 10/2007
(Continued)

OTHER PUBLICATIONS

International Search Report for corresponding Application No. PCT/JP2016/058405; dated Jun. 7, 2016.
(Continued)

*Primary Examiner* — Michael E Gallion
(74) *Attorney, Agent, or Firm* — Cantor Colburn LLP

(57) ABSTRACT

A rope hoist includes a rope drum mechanism easy to attach to a frame structure and clarified positioning reference. The rope drum is rotatably supported by a first support part on one end side and a second support part on another end side of the rope drum. A pair of supporting ribs having clearances with respect to a first drum support frame is provided with the first support part. A first connection member penetrates the supporting ribs and the first drum support frame in a state of both-end support. A second connection member penetrates a frame attachment portion and a second drum support frame in a state of cantilever. A support shaft couples the first support part and the second support part and is arranged on an axis passing through a position different from
(Continued)

positions of the first connection member and the second connection member.

8 Claims, 20 Drawing Sheets

(51) Int. Cl.

| | |
|---|---|
| ***B66D 3/26*** | (2006.01) |
| ***B66C 11/04*** | (2006.01) |
| ***B66C 13/50*** | (2006.01) |
| ***B66D 1/12*** | (2006.01) |
| ***B66D 1/22*** | (2006.01) |
| ***B66D 1/38*** | (2006.01) |
| ***B66D 1/56*** | (2006.01) |
| ***B66D 3/08*** | (2006.01) |
| ***B66D 5/02*** | (2006.01) |

(52) U.S. Cl.
CPC ..... *B66D 1/22* (2013.01); *B66D 1/28* (2013.01); *B66D 1/38* (2013.01); *B66D 1/56* (2013.01); *B66D 3/08* (2013.01); *B66D 3/26* (2013.01); *B66D 5/02* (2013.01); *B66D 2700/025* (2013.01)

(58) Field of Classification Search
CPC ..... B66D 3/26; B66D 5/02; B66D 2700/025; B66C 11/04; B66C 13/50
See application file for complete search history.

(56) References Cited

U.S. PATENT DOCUMENTS

| | | | | |
|---|---|---|---|---|
| 8,789,812 | B2 * | 7/2014 | Imbusch | B66D 1/28 254/329 |
| 9,950,904 | B2 * | 4/2018 | Kosuga | B66C 1/34 |
| 10,273,128 | B2 * | 4/2019 | Kosuga | B66D 3/24 |
| 2014/0001427 | A1 * | 1/2014 | Fretz | B66D 1/02 254/342 |
| 2014/0027691 | A1 | 1/2014 | Ilaka et al. | |
| 2015/0314998 | A1 * | 11/2015 | Ishikawa | B66D 3/16 254/358 |
| 2017/0081152 | A1 * | 3/2017 | Kosuga | B66C 1/34 |
| 2017/0107084 | A1 * | 4/2017 | Yudate | B66C 11/16 |
| 2018/0162702 | A1 * | 6/2018 | O'Connor | B66D 5/14 |
| 2019/0194001 | A1 * | 6/2019 | Wang | B66D 1/12 |

FOREIGN PATENT DOCUMENTS

| | | | |
|---|---|---|---|
| CN | 101190773 | A | 6/2008 |
| CN | 202054558 | U | 11/2011 |
| EP | 0598930 | A1 | 6/1994 |
| JP | 2006306539 | A | 11/2006 |
| JP | 2013511450 | A | 4/2013 |
| JP | 2013511451 | A | 4/2013 |

OTHER PUBLICATIONS

SIPO Office Action corresponding to CN Application No. 201680024841.3; dated Sep. 28, 2018.
Indian Office Action corresponding to counterpart Application No. 201747041763; dated Aug. 14, 2019.

* cited by examiner

ROPE HOIST

Cross Reference To Related Applications

This is a U.S. national stage of application No. PCT/JP2016/058405, filed on Mar. 16, 2016. Priority under 35 U.S.C.§ 119(a) and 35 U.S.C.§ 365(b) is claimed from Japanese Patent Applications No. 2015-094012 filed on May 1, 2015, the disclosure of which is also incorporated herein by reference.

TECHNICAL FIELD

The present invention relates to a rope hoist used for an operation of discharging a cargo.

BACKGROUND ART

To move a cargo in the vertical direction and move the suspended cargo along a rail laid on the ceiling side, a rope hoist is generally used. The rope hoist includes a rope drum around which a wire rope is to be wound, and the rope drum is rotated by a drum motor. The rope hoist also includes a trolley mechanism for the movement along the rail on the ceiling side. The trolley mechanism includes a wheel in contact with a flange of the rail and includes a traversing motor that applies driving force to the wheel.

Examples of the rope hoist include the one disclosed in PTL 1. In PTL 1, both end sides of a cable drum 2 are rotatably supported by a first base plate 4*a* and a second base plate 4*b*. The first base plate 4*a* and the second base plate 4*b* are coupled by longitudinal beams 5*a* to 5*c*. In the coupling, cylindrical holding components 13*a*, 13*b* are used, screws 11, 16 are inserted into inner holes of the holding components 13*a*, 13*b*, and the screws are screwed into threaded holes of beam ends 5*d*, 5*e* of the longitudinal beam 5*a*.

Further, the holding components 13*a*, 13*b* are inserted into an attachment hole 18*b* of an attachment element 18. Therefore, a rope drum mechanism including the cable drum 2 is attached to a cable winch 1 (rope hoist) via the holding components 13*a*, 13*b*.

CITATION LIST

Patent Literature

{PTL 1} JP 2013-511450A

SUMMARY OF INVENTION

Technical Problem

Incidentally, in PTL1, for example, in maintenance of the rope hoist, unless the screws 11, 16 are detached and the holding components 13*a*, 13*b* are detached, the rope drum mechanism cannot be detached from the attachment element 18. However, if the screws 11, 16 and the holding components 13*a*, 13*b* are detached, the longitudinal beams 5*a*, 5*c* also come to be detached, resulting in that components constituting the rope drum mechanism are fallen to pieces.

Besides, in the case of manufacturing the rope hoist, if the rope drum mechanism is singly assembled, the screws 11, 16 and the holding components 13*a*, 13*b* need to be detached at the time of attachment to the attachment element 18. Therefore, attaching the rope drum mechanism to the attachment element 18 takes a lot of labor. To avoid the labor, it is conceivable to assemble the rope drum mechanism at the time of attaching the rope drum mechanism to the attachment element 18. In this case, however, the rope drum mechanism comes into a state where it cannot be singly assembled as one unit. Accordingly, the rope hoist disclosed in PTL 1 is inferior in manufacturing efficiency, Further, in the configuration disclosed in PTL 1, the holding component 13*a* is supported, in a both-end support state, by the first base plate 4*a* and a second cover 6*b*. Besides, the holding component 13*b* is supported, in a both-end support state, by the second base plate 4*b* and a holding element 7. In this case, it is not clear which of the holding component 13*a* and the holding component 13*b* is used as a reference for positioning. Therefore, the reference for positioning may be influenced by the way of assembly. Further, in the above-described support in the both-end support state, components such as a spacer and the like for positioning are also additionally required, bringing about a problem of increasing the number of components.

The present invention has been made based on the above circumstances, and its object is to provide a rope hoist capable of improving attachability of a rope drum mechanism to a frame structure and clarifying a reference for positioning.

Solution to Problem

To solve the above problem, according to a first viewpoint of the present invention, there is provided a rope hoist which hoists and lowers a cargo suspended from the rope hoist via a wire rope by changing a winding length of the wire rope due to rotation of a rope drum, the rope hoist including: a frame structure including a first drum support frame and a second drum support frame which project to the rope drum side, the frame structure supporting parts; a first support part which rotatably supports the rope drum on one end side in an axial direction of the rope drum; a second support part which rotatably supports the rope drum on another end side in the axial direction of the rope drum; a pair of supporting ribs which are provided with the first support part and arranged in a state of having clearances with respect to the first drum support frame and in a state of holding the first drum support frame therebetween; a first connection member which penetrates the pair of supporting ribs and the first drum support frame and is thereby mechanically connected to the first drum support frame in a state of the pair of supporting ribs being both-end support; a frame attachment portion which is provided on the second support part and comes, at least a part thereof, into surface contact with the second drum support frame; a second connection member which penetrates the frame attachment portion and the second drum support frame and is thereby mechanically connected to the second drum support frame in a state of the frame attachment portion being cantilever; and a support shaft which couples the first support part and the second support part and is arranged on an axis passing through a position different from positions of the first connection member and the second connection member.

Further, in another aspect of the present invention in the above invention, it is preferable that the first support part is a gear body to which a drum motor configured to apply driving force of rotating the rope drum is attached and which pivotally supports a gear train configured_to transmit the driving force of the drum motor to the rope drum.

Further, in still another aspect of the present invention in the above invention, it is preferable that: the second connection member includes a cylindrical connection cylinder, and a coupling bolt being inserted to the connection cylinder; and the first connection member includes a columnar or cylindrical connection pin, and coming-off preventing members which prevent coming off of the connection pin at projecting portions of the connection pin projecting from the pair of supporting ribs.

Further, in yet another aspect of the present invention in the above invention, it is preferable that the first connection member and the second connection member are arranged on the same axis.

Advantageous Effects of Invention

According to the present invention, it becomes possible, in a rope hoist, to improve attachability of a rope drum mechanism to a frame structure and to clarify a reference for positioning.

DESCRIPTION OF EMBODIMENT

Figure 1:
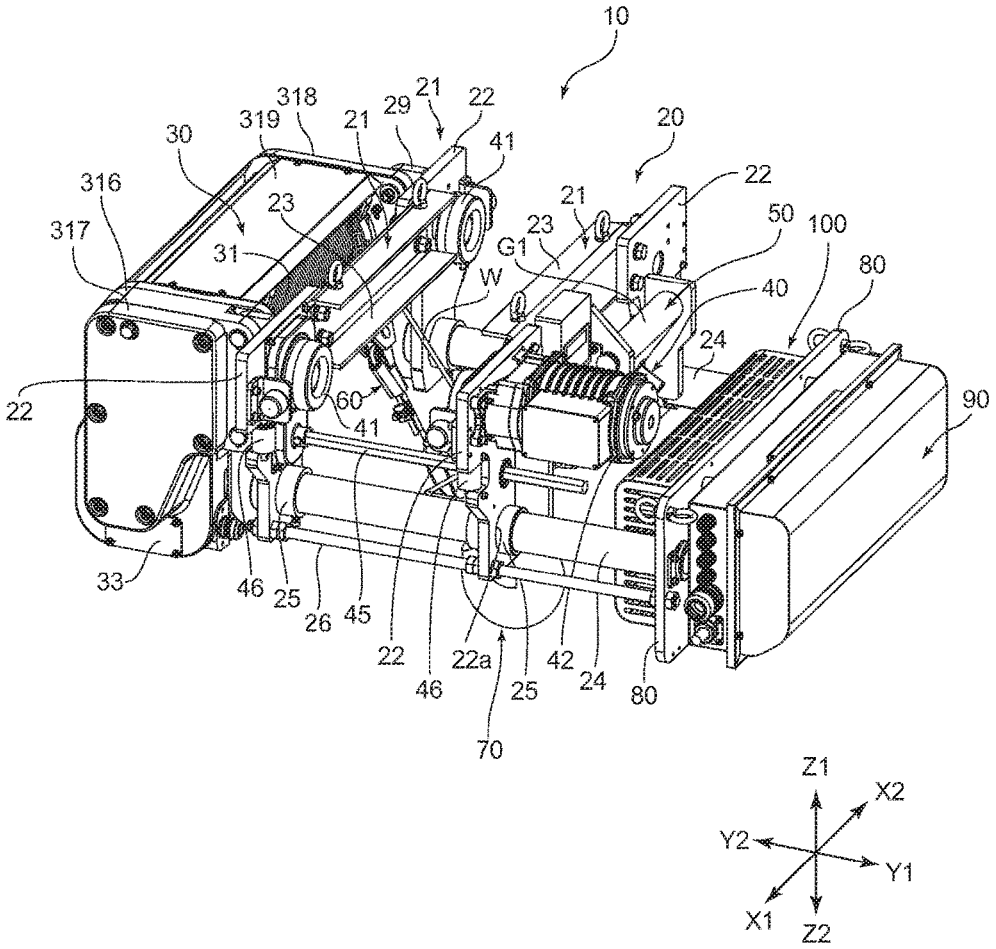
FIG. 1 is a perspective view illustrating the whole configuration of a rope hoist according to one embodiment of the present invention when viewed from the front side.

Hereinafter, a rope hoist 10 according to an embodiment of the present invention will be described based on the drawings. Note that in the following description, an XYZ orthogonal coordinate system is used as necessary for description. An X-direction in the XYZ orthogonal coordinate system indicates a direction in which rails extend, an X1 side indicates a side, where a drum motor 33 and a traversing motor 42 are located, in a longitudinal direction of the rope hoist 10, and an X2 side indicates a side opposite thereto. A Z-direction indicates a vertical direction, a Z1 side indicates an upper side (namely, a side where rails R are located as viewed from a hook block 70), and a Z2 side indicates a lower side opposite thereto. Further, a Y-direction indicates a direction (a width direction of the rail R) orthogonal to the X-direction and the Z-direction, a Y1 side indicates a side where a trolley mechanism 40 is located as viewed from a rope drum mechanism 30, and a Y2 side indicates a side opposite thereto.

<1. Regarding the Whole Configuration of the Rope Hoist 10>

Figure 2:
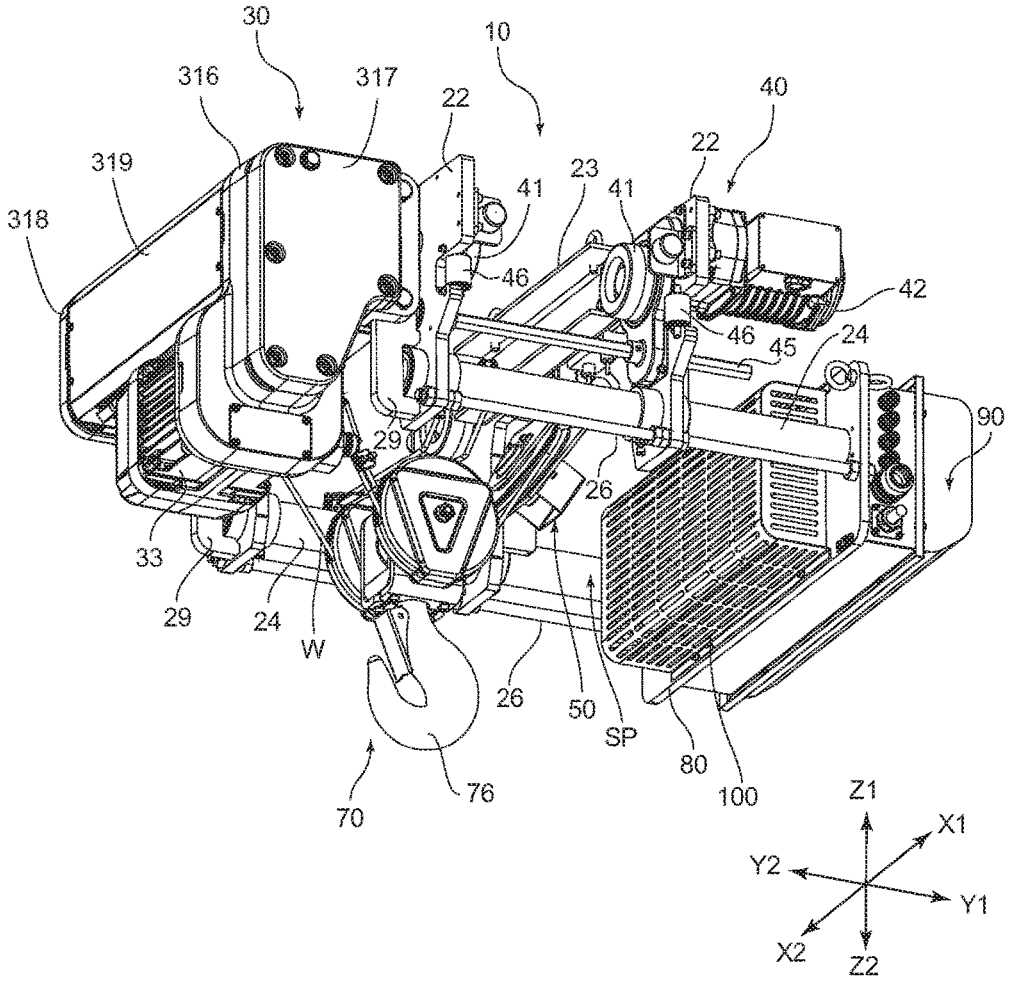
FIG. 2 is a perspective view illustrating the whole configuration of the rope hoist in FIG. 1 when viewed from the rear side.
Figure 3:
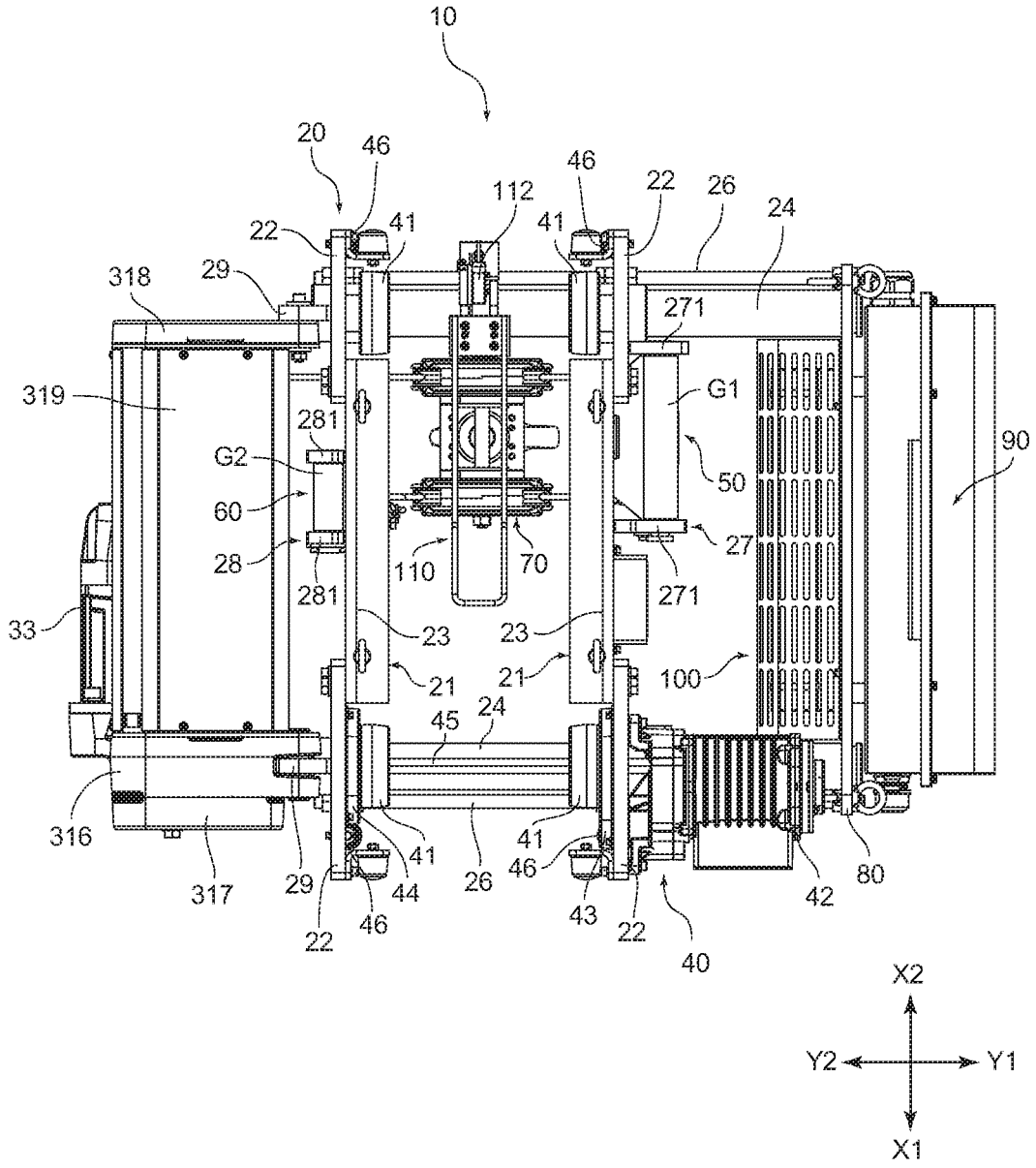
FIG. 3 is a plan view illustrating the configuration of the rope hoist in FIG. 1 when viewed from the upper side.
Figure 4:
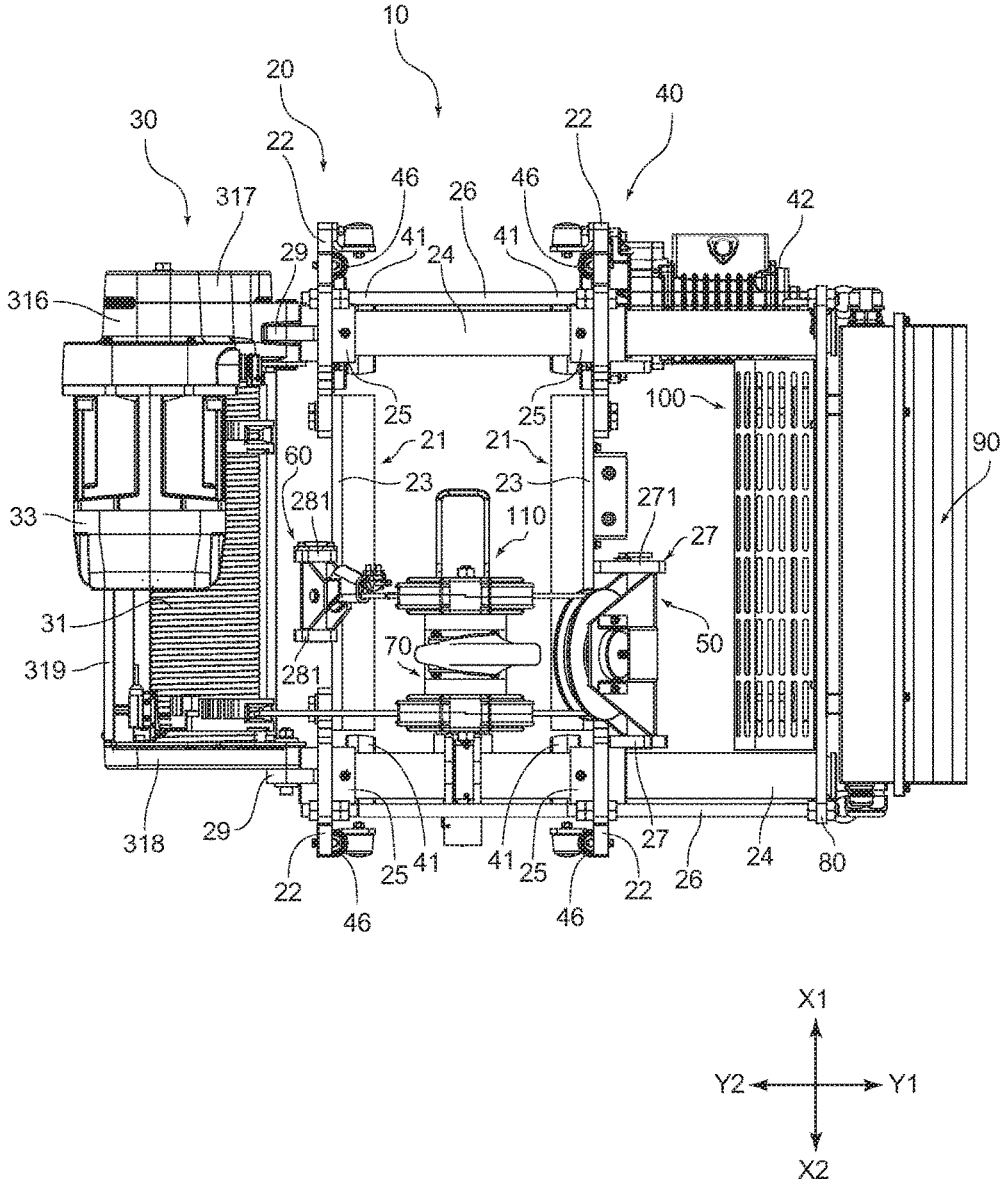
FIG. 4 is a bottom view illustrating the configuration of the rope hoist in FIG. 1 when viewed from the lower side.
Figure 5:
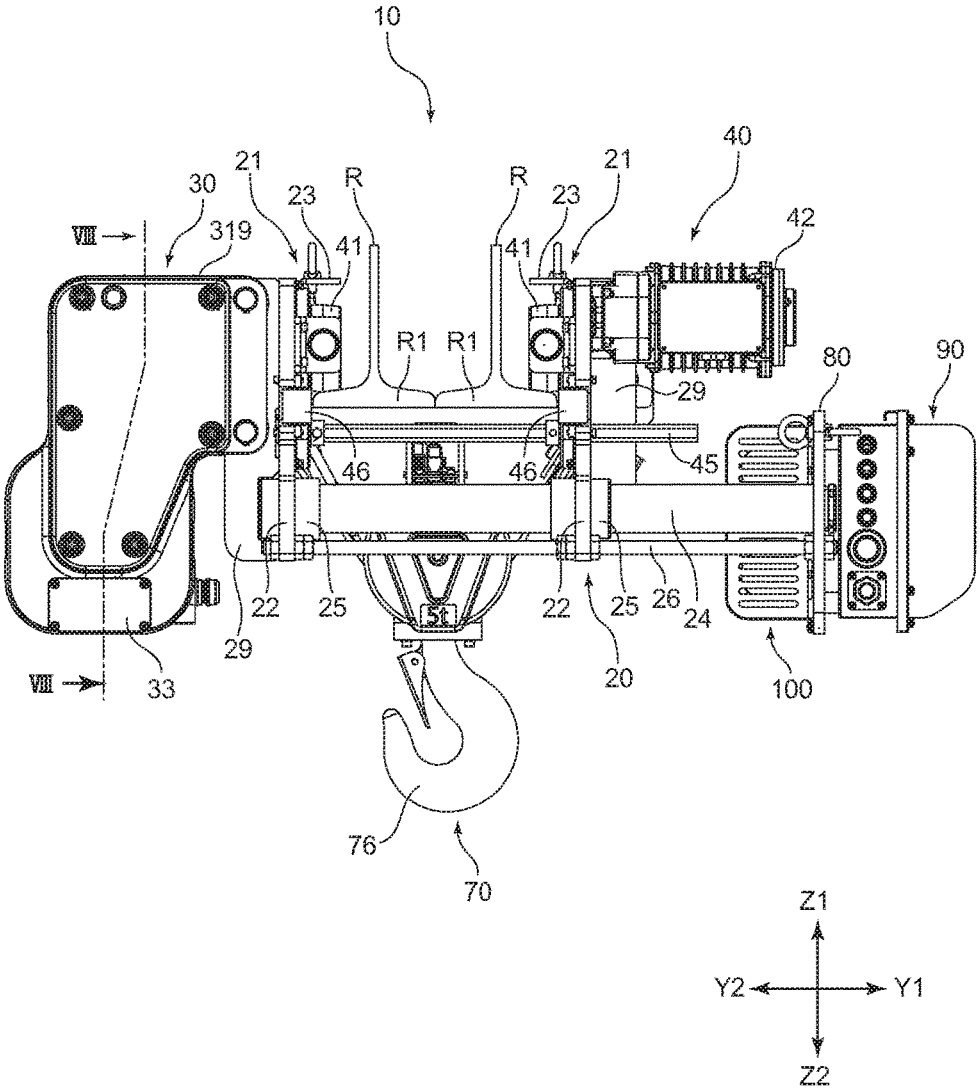
FIG. 5 is a front view illustrating the configuration of the rope hoist in FIG. 1 when viewed from the front side.
Figure 6:
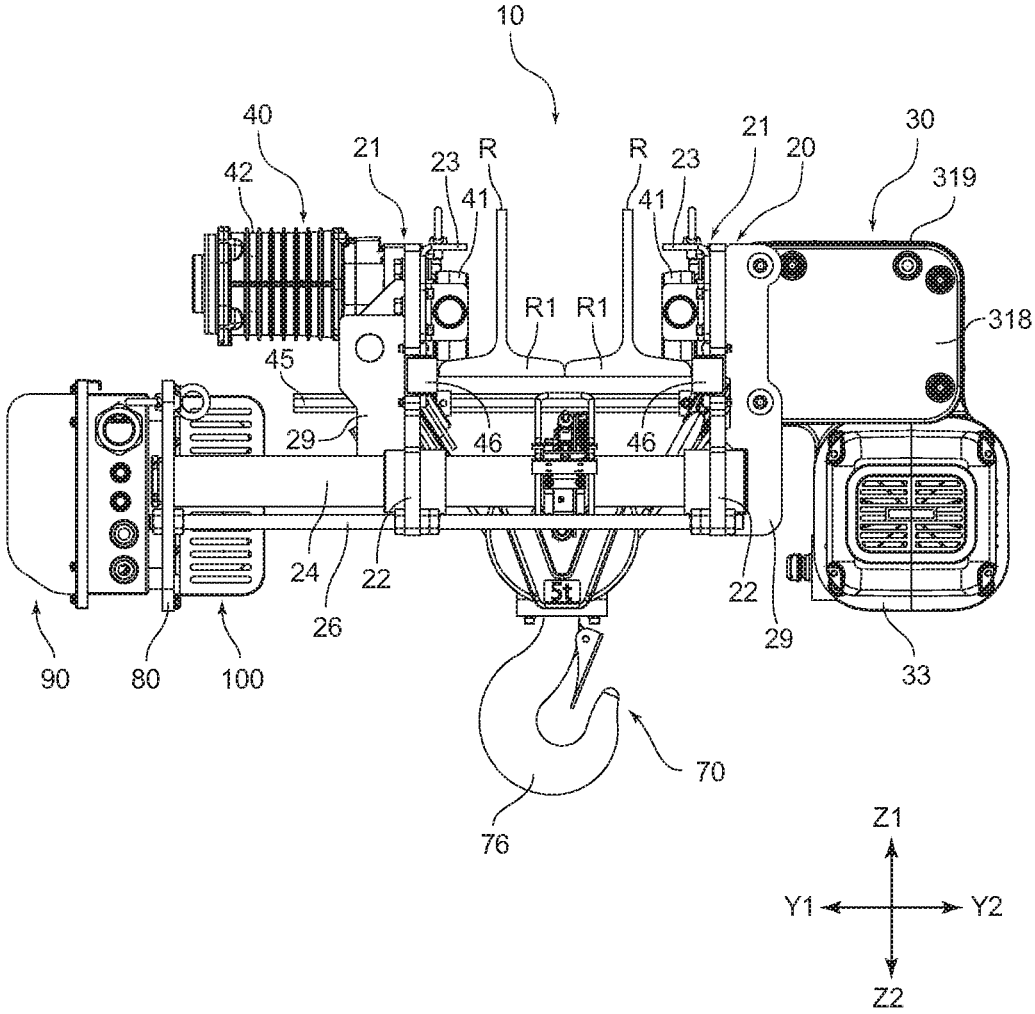
FIG. 6 is a rear view illustrating the configuration of the rope hoist in FIG. 1 when viewed from the rear side.

FIG. 1 is a perspective view illustrating the whole configuration of the rope hoist 10 when viewed from the front side. FIG. 2 is a perspective view illustrating the whole configuration of the rope hoist 10 when viewed from the rear side. FIG. 3 is a plan view illustrating the configuration of the rope hoist 10 when viewed from the upper side. FIG. 4 is a bottom view illustrating the configuration of the rope hoist 10 when viewed from the lower side. FIG. 5 is a front view illustrating the configuration of the rope hoist 10 when viewed from the front side. FIG. 6 is a rear view illustrating the configuration of the rope hoist 10 when viewed from the rear side.

As illustrated in FIG. 1 to FIG. 6, the rope hoist 10 includes a frame structure 20, the rope drum mechanism 30, the trolley mechanism 40, an intermediate sheave body 50, a rope fixing member 60, the hook block 70, a counterweight 80, a control unit 90, a braking resistor 100, and a direct-acting switch mechanism 110.

<2. Regarding the Frame Structure 20>

Figure 7:
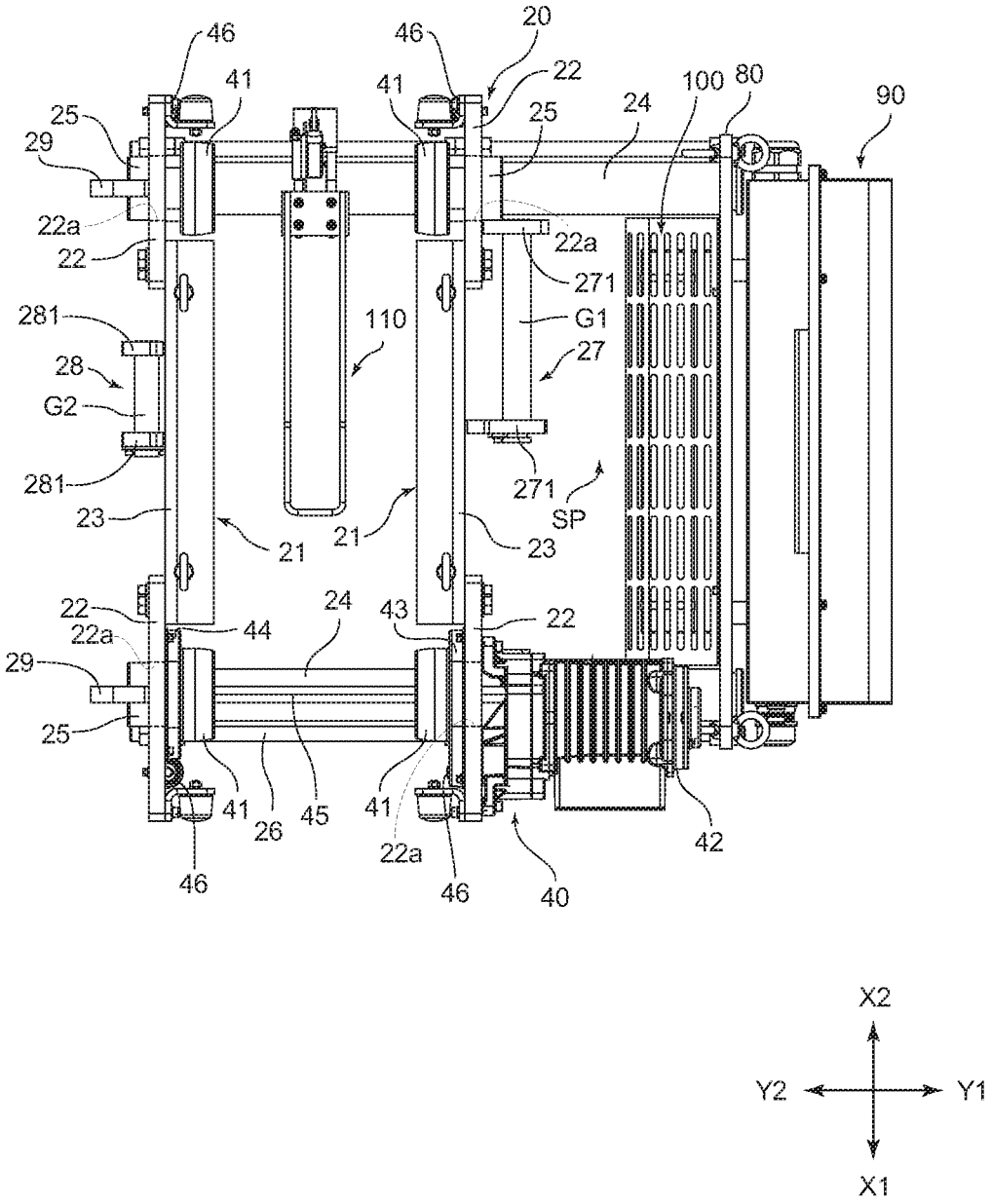
FIG. 7 is a plan view illustrating the configurations of a trolley mechanism and a frame structure in the rope hoist in FIG. 1.

The frame structure 20 will be described first. FIG. 7 is a plan view illustrating the configurations of the frame structure 20 and the trolley mechanism 40. As illustrated in FIG. 7, the frame structure 20 has a pair of front-rear frames 21, coupling bars 24, drum support frames 29, and attachment frames 271, and supports the whole rope hoist 10 using them.

The front-rear frames 21 are frames extending longitudinally in the extending direction (X-direction) of the rails R, and are provided on the right side and the left side (the Y1 side and the Y2 side) respectively across the rails R. The pair of front-rear frames 21 each have two support frames 22 and a coupling frame 23 connecting the support frames 22. To the support frame 22, various members including a wheel 41 are attached. Further, the support frame 22 is provided with an insertion hole 22*a*, and a later-described bush 25 is inserted into the insertion hole 22*a*.

To the support frame 22, the coupling frame 23 is coupled, for example, with a bolt or the like. Note that as the bolt coupling the support frame 22 and the coupling frame 23, a bolt excellent in positioning, such as a reamer bolt, is preferably used after a not-illustrated reamer hole is formed In the configuration illustrated in FIG. 1 to FIG. 6, the coupling frame 23 is located between the two support frames 22 along the extending direction (X-direction) of the rail R. The coupling frame 23 is provided having a U-shape as a shape when viewed from the front as illustrated in FIG. 1 and so on. Note that the coupling frame 23 is located on a side closer to the rail R side than is the support frame 22, thereby achieving effective use of a space located between the front-rear frames 21 facing each other in the Y-direction. Note that the support frame 22 is provided in a state of not a thin plate but a thick plate so as to be able to support the various members including the wheel 41.

The frame structure 20 also has the coupling bars 24. The coupling bar 24 is a portion extending along the width direction (Y-direction). The coupling bar 24 is inserted into the above-described insertion hole 22*a* via the bush 25 as illustrated in FIG. 1 and so on, and thereby attached to the support frame 22. Here, on another end side (Y2 side) of the coupling bar 24, the other front-rear frame 21 of the pair of front-rear frames 21 is fixed. Further, at a middle portion of the coupling bar 24, the front-rear frame 21 on one side is fixed, and the counterweight 80 is fixed on one end side (Y1 side) of the coupling bar 24.

Further, the bush 25 is fixedly attached to the insertion hole 22*a*. Into the bush 25, a fixing means such as a screw can be screwed, so that the screwing decides the position of the support frame 22 with respect to the coupling bar 24. However, in this embodiment, the drum support frame 29 lies over an opening on the other end side (Y2 side) of the bush 25 located on the other end side (Y2 side) in the width direction, so that the coupling bar 24 bumps against the drum support frame 29 to thereby decide the position of the front-rear frame 21 on the other side (Y2 side) with respect to the coupling bar 24. However, loosening a fastening means such as a bolt makes it possible to freely change the front-rear frame 21 on the one side (Y1 side) with respect to the coupling bar 24. Thus, in mounting the rope hoist 10, the front-rear frame 21 on the one side (Y1 side) can be separated from the front-rear frame 21 on the other side (Y2 side).

Note that as illustrated in FIG. 6 and so on, the frame structure 20 is provided with coupling assist bars 26. The coupling assist bars 26 are threaded rods that adjust the positions of nuts to make it possible to adjust the position in the width direction (Y-direction) of the front-rear frame 21 on the one side (Y1 side) with respect to the front-rear frame 21 on the other side (Y2 side). In other words, in the case of mounting the rope hoist 10, the interval between the pair of front-rear frames 21 is kept to be a predetermined interval, the interval between the pair of front-rear frames 21 is adjusted to be appropriate after the mounting, and the interval is kept by fastening of the nuts or the like after the adjustment. In keeping the interval, for example, the front-rear frame 21 on the one side (Y1 side) can be fixed by fastening one nut to the surface on the other side (Y2 side) of the support frame 22, and fastening two nuts to the surface on the one side (Y1 side) of the support frame 22 (double nut).

Note that in the configuration illustrated in FIG. 7, to the frame structure 20, an intermediate sheave support part 27 and a terminal support part 28 are attached. The intermediate sheave support part 27 is a portion that supports a suspender shaft G1 supporting the later-described intermediate sheave body 50, and is arranged on the one side (Y1 side) in the width direction (Y-direction) of the frame structure 20 in the configuration illustrated in FIG. 7 and so on. To support the above-described suspender shaft G1, the intermediate sheave support part 27 has a pair of attachment frames 271, and the attachment frames 271 are attached to the pair of support frames 22 separated in the longitudinal direction (X-direction), respectively.

Because the intermediate sheave support part 27 is arranged on the one side (Y1 side) in the width direction (Y-direction) of the frame structure 20 as described above, the attachment frames 271 project toward the one side (Y1 side) in the width direction (Y-direction).

Besides, the terminal support part 28 is a portion that supports a terminal support shaft G2 supporting the later-described rope fixing member 60, and is arranged on the other side (Y2 side) in the width direction (Y-direction) of the frame structure 20 in the configuration illustrated in FIG. 7 and so on. The terminal support part 28 has a pair of shaft holding parts 281, and the shaft holding parts 281 are attached to the pair of support frames 22 separated in the longitudinal direction (X-direction), respectively.

Further, the frame structure 20 is provided with the drum support frames 29 projecting toward the other side (Y2 side) in the width direction (Y-direction). A pair of the drum support frames 29 are provided on each of the front-rear frames 21, and the drum support frames 29 are attached to the support frames 22 separated in the longitudinal direction (X-direction), respectively. To the pair of drum support frames 29, one end side and the other end side of the rope drum mechanism 30 described next are fixed, respectively. Note that the drum support frames 29 are attached to the support frames 22 respectively by welding or the like but may be attached by other methods.

Note that the drum support frame 29 on the front side (X1 side) corresponds to a first drum support frame, and the drum support frame 29 on the rear side (X2 side) corresponds to a second drum support frame.

<3. Regarding the Rope Drum Mechanism 30>

Next, the rope drum mechanism 30 will be described. As illustrated in FIG. 1 to FIG. 6 and so on, the rope drum mechanism 30 has a rope drum 31, a rope guide mechanism 32, the drum motor 33, and a reduction mechanism 34 as main components.

Figure 8:
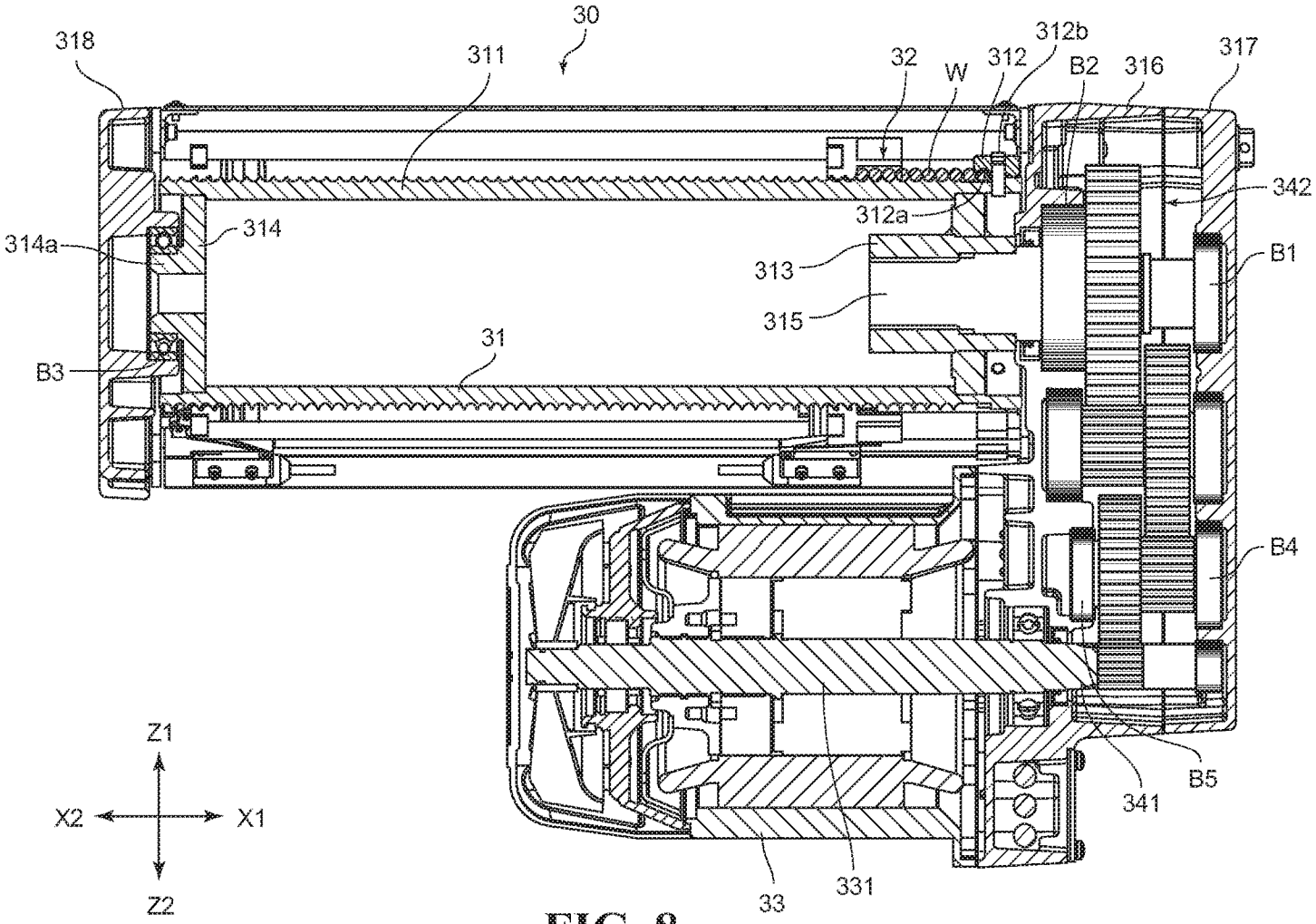
FIG. 8 is a view illustrating a cross section obtained by cutting along a line A-A indicated by arrows in FIG. 5.

FIG. 8 is a side view illustrating the configuration of the rope drum 31, and illustrating a cross section obtained by cutting the vicinity of the rope drum 31 and the vicinity of the drum motor 33. Note that FIG. 8 illustrates a cross section obtained by cutting along a line A-A indicated by arrows in FIG. 5. As illustrated in FIG. 8, the rope drum 31 is a drum-shaped member around which a wire rope W is to be wound, and is formed, on its outer peripheral side, with a spiral groove 311 in a recessed groove shape in which the wire rope W is to be fitted. The spiral groove 311 is formed in a spiral shape on the outer periphery of the rope drum 31, and formed corresponding to the radius of the wire rope W. Further, the spiral groove 311 is formed such that the wire rope W is lined up therein in a row in a not-overlapping state (in a single layer state).

Note that to the one end side (front side; X1 side) of the rope drum 31, a rope pressing metal fitting 312 for fixing one end side of the wire rope W is attached. The rope pressing metal fitting 312 includes a recessed portion 312*a* in which the wire rope W is to be located, and a screw 312*b* being a fastening means is firmly screwed into the rope drum 31 with the wire rope W located in the recessed portion 312*a*. Thus, the one end side of the wire rope W is fixed to the rope drum 31.

Further, to the one end side (front side; X1 side) and the other end side (rear side; X2 side) of the rope drum 31, pivotal support parts 313, 314 are attached, respectively. As illustrated in FIG. 8, to the pivotal support part 313 on the one end side (front side; X1 side), a drum rotation shaft 315 is coupled, for example, by spline coupling. The drum rotation shaft 315 is attached to a gear body 316 and to a gear case 316*b* via bearings B1, B2 as shaft bearings. The gear body 316 pivotally supports gears constituting a gear train 342 and additionally has the drum motor 33 attached thereto. The gear case 316*b* also pivotally supports the gears constituting the gear train 342, and is fixed to the gear body 316 via a screw or the like to additionally protect the gear train 342 from outside.

Besides, to an annular projecting portion 314*a* on the center side in the radial direction of the pivotal support part 314 on the other end side (rear side; X2 side) of the rope drum 31, a bearing B3 is attached, and the outer peripheral side of the bearing B3 is attached to a back frame 318. Thus, the other end side of the rope drum 31 is also rotatably supported. Note that as illustrated in FIG. 1 and so on, the rope drum 31 is covered, on its upper side, with a cover frame 319.

Figure 9:
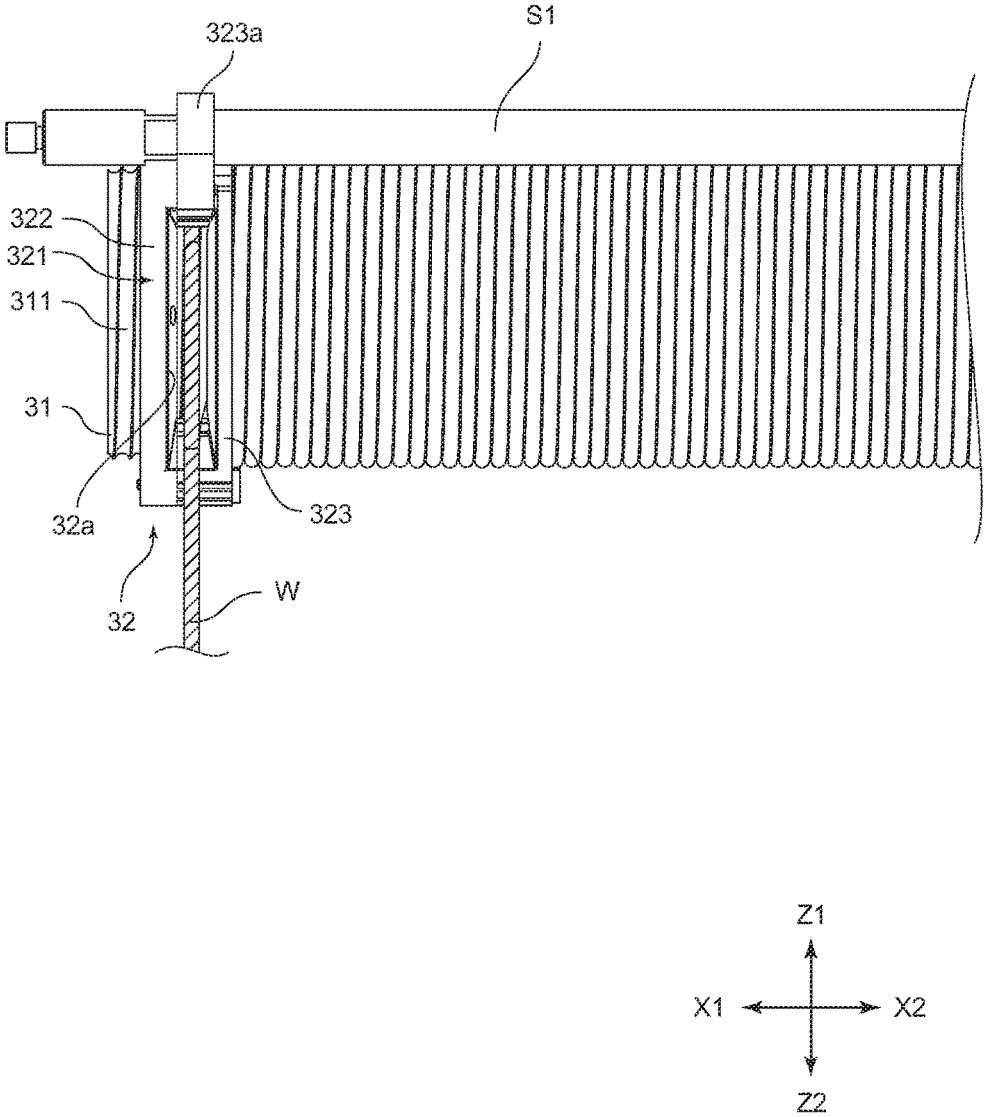
FIG. 9 is a partial side view of a rope drum for illustrating the vicinity of a rope guide mechanism in the rope hoist in FIG. 1.
Figure 10:
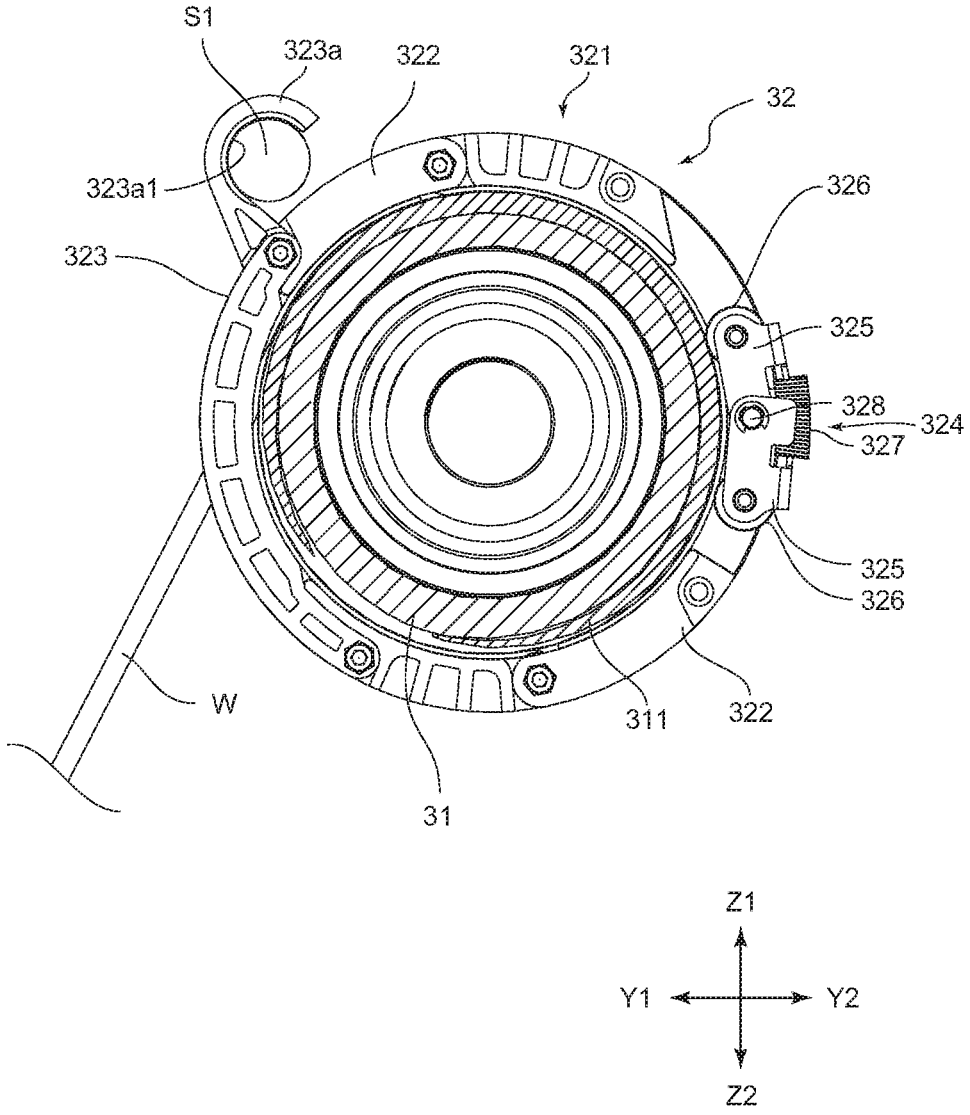
FIG. 10 is a rear view illustrating a cross section of the rope drum in the rope hoist in FIG. 1 and illustrating the configuration of the rope guide mechanism.

FIG. 9 is a partial side view of the rope drum 31 for illustrating the vicinity of the rope guide mechanism 32. FIG. 10 is a rear view illustrating a cross section of the rope drum 31 and illustrating the configuration of the rope guide mechanism 32. As illustrated in FIG. 9 and FIG. 10, the rope guide mechanism 32 is a member that moves in a front-rear direction (X-direction) while being guided by a support shaft S1 accompanying the rotation of the rope drum 31. Note that a support form of support shafts S1 to S3 including the support shaft S1 will be described later.

As illustrated in FIG. 9 and FIG. 10, the rope guide mechanism 32 includes a ring-shaped member 321, circumferential members 322, and a guide roller body 324 as main components.

As illustrated in FIG. 10, the ring-shaped member 321 is a member formed into a ring shape by combining a plurality of, for example, two circumferential members 322 and a guide member 323. On the inner peripheral side of the ring-shaped member 321, a not-illustrated spiral projecting portion is provided which is fitted in the spiral groove 311 of the rope drum 31. The spiral projecting portion is provided in a circumferential shape forming a spiral, and is provided at the inner peripheral side of the ring-shaped member 321 in a manner to face a non-wound side of the wire rope W.

Further, as illustrated in FIG. 9, between the circumferential member 322 and the guide member 323, a guide opening portion 32*a* that guides the wire rope W is provided. Note that the guide opening portion 32*a* is an opening portion for leading the wire rope W to be wound around the rope drum 31 while guiding the wire rope W to the spiral groove 311, and is provided in a long-hole opening shape.

Further, as illustrated in FIG. 10, the guide member 323 is provided with a guide portion 323*a*. The guide portion 323*a* is provided in a curved hook shape, and is in contact with the support shaft S1 at a recessed portion 323*a*1 being the inside of the curve. The support shaft S1 is fitted in the recessed portion 323*a*1, whereby the rope guide mechanism 32 becomes satisfactorily movable in the front-rear direction (X-direction).

Besides, as illustrated in FIG. 10, the guide roller body 324 is attached to the circumferential member 322 on the right side (Y2 side). The guide roller body 324 has a pair of roller supporters 325, rollers 326, a biasing spring 327, and an attachment shaft 328. The pair of roller supporters 325 are coupled to each other via the attachment shaft 328. The roller supporters 325 support the rollers 326 to be rotatable. Besides, the biasing spring 327 is a compression spring, and end portion sides of the biasing spring 327 are supported by the pair of roller supporters 325, respectively. The biasing spring 327 therefore applies, to the rollers 326, biasing force in a direction of pressing the wire rope W against the spiral groove 311.

The rope guide mechanism 32 having the above configuration enables the wire rope W to fit into the spiral groove 311 of the rope drum 31 via the guide opening portion 32*a*. The rope guide mechanism 32 also enables the wire rope W to lead out of the spiral groove 311 to the outside via the guide opening portion 32*a*. In this event, the guide roller body 324 is provided on the opposite side in the circumferential direction with respect to the guide opening portion 32*a* and the rollers 326 press the wire rope W, thereby preventing the wire rope W from coming off the spiral groove 311.

Besides, as illustrated in FIG. 8, to the gear body 316, the drum motor 33 is attached. The drum motor 33 is configured to apply driving force of rotating the rope drum 31. To an output shaft 331 of the drum motor 33, a pinion gear 341 constituting the reduction mechanism 34 is attached, and driving force of the pinion gear 341 is transmitted through the gear train 342 to the drum rotation shaft 315. Note that the output shaft 331 is also attached to the gear body 316 via bearings B4, B5 as shaft bearings.

<4. Regarding a Limit Switch Mechanism 35>

Next, limit switch mechanisms 35*a*, 35*b* will be described. The rope drum mechanism 30 includes the limit switch mechanisms 35*a*, 35*b* for stopping the drum motor 33 when hoisting the wire rope W to a predetermined position or when rewinding the wire rope W to a predetermined position.

Figure 11:
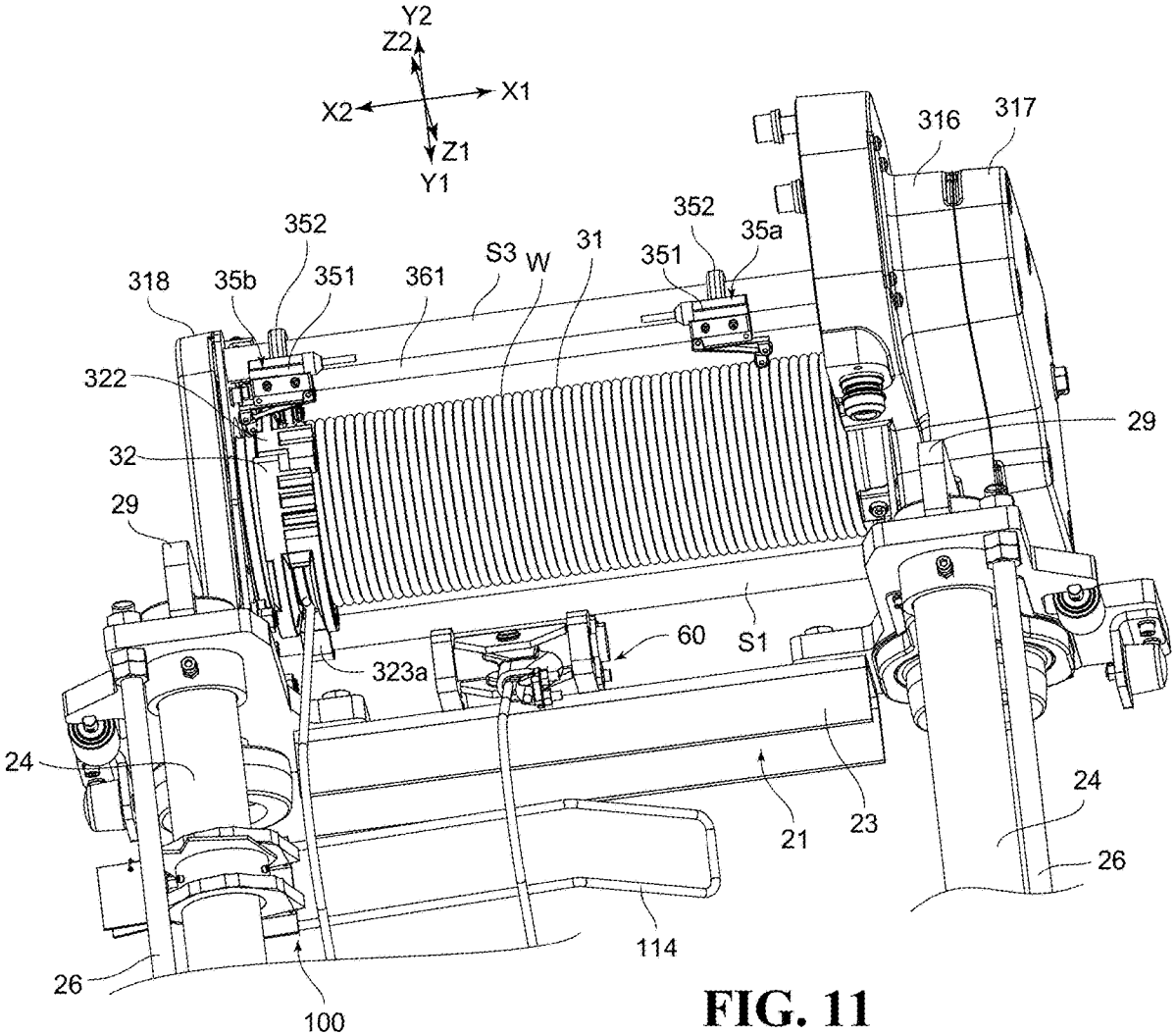
FIG. 11 is a perspective view illustrating a state where drum limit switch mechanisms are arranged in a rope drum mechanism of the rope hoist in FIG. 1.
Figure 12:
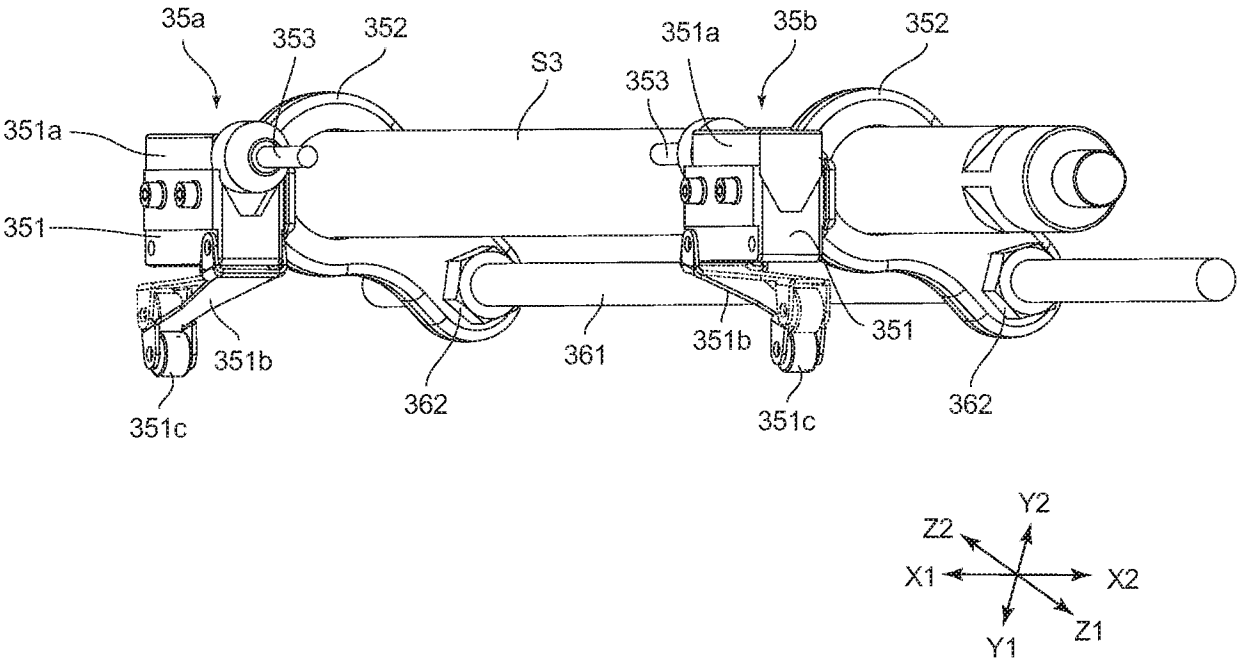
FIG. 12 is a perspective view illustrating a state where the drum limit switch mechanisms in the rope hoist in FIG. 1 are attached to a support shaft and to a position adjustment bolt.

FIG. 11 is a perspective view illustrating a state where drum limit switch mechanisms 35*a*, 35*b* are arranged in the rope drum mechanism 30. FIG. 12 is a perspective view illustrating a state where the drum limit switch mechanisms 35*a*, 35*b* are attached to a support shaft S3 and to a position adjustment bolt 361. As illustrated in FIG. 11 and FIG. 12, the drum limit switch mechanism 35*a* is arranged at an end portion in an X1-direction of the rope drum 31. On the other hand, the drum limit switch mechanism 35*b* is arranged in an X2-direction (fixed end side of the wire rope W) of the rope drum 31. More specifically, the drum limit switch mechanism 35*a* is arranged at a position corresponding to a lowering limit of the wire rope W. On the other hand, the drum limit switch mechanism 35*b* is arranged at a position corresponding to a hoisting limit of the wire rope W. The state illustrated in FIG. 11 illustrates a state where the wire rope W is hoisted to a predetermined position of a hoisting limitation and illustrate a state where the rope guide mechanism 32 is located on the X2 side.

The limit switch mechanisms 35*a*, 35*b* directly detect the circumferential members 322 of the rope guide mechanism 32. Detection signals are then transmitted to the control unit 90 via a cable 353. Thus, the drum motor 33 stops the operation on the basis of the control by the control unit 90. Note that the operation of the drum motor 33 may be stopped not by the control by the control unit 90 but by directly transmitting the detection signals to the motor driver or the like.

Note that, as described later, the rope drum 31 is also provided with the direct-acting switch mechanism 110 configured to stop the operation of the drum motor 33 similarly to the above-described drum limit switch mechanisms 35*a*, 35*b*. Therefore, the drum limit switch mechanism 35*b* is configured to stop the drive of the drum motor 33 before the direct-acting switch mechanism 110 is operated yet.

The limit switch mechanisms 35*a*, 35*b* include attaching metal fittings 352, and limit switch main body parts 351 are attached to the support shaft S3 via the attaching metal fittings 352. Note that for adjusting the attachment positions of the limit switch mechanisms 35*a*, 35*b*, the position adjustment bolt 361 is provided. Adjusting the positions of the limit switch mechanisms 35*a*, 35*b* with respect to the position adjustment bolt 361 enables adjustment of the positions of the limit switch mechanisms 35*a*, 35*b*. Note that the attaching metal fitting 352 is configured such that its attachment position is adjustable by adjusting the positions of a nut 362.

Besides, the limit switch main body part 351 includes a main body portion 351*a* in a box shape in which a not-illustrated switch mechanism capable of switching between ON and OFF is attached, and the cable 353 is electrically connected to the switch mechanism. The limit switch main body part 351 further includes a switch lever 351*b*, and the switch lever 351*b* is turnably attached to the main body portion 351*a*. The switch lever 351*b* is configured to be able to push in a switch (not illustrated) that can enter and exit the main body portion 351*a*. Therefore, the switch mechanism is configured to be switched between ON and OFF depending on whether the switch lever 351*b* turns to push in the switch or not.

Further, on the tip end side of the switch lever 351*b*, a roller 351*c* is turnably attached, and the roller 351*c* can come into contact with the circumferential member 322 of the rope guide mechanism 32. The turning amount of the switch lever 351*b* changes depending on whether or not the roller 351*c* comes into contact with the circumferential member 322, thereby switching between ON and OFF of the switch mechanism. This enables the limit switch mechanisms 35*a*, 35*b* to detect whether or not the wire rope W has reached the lowering limit or the hoisting limit.

<5. Regarding the Attachment Structure of the Rope Drum Mechanism 30 to the Drum Support Frames 29>

Figure 13:
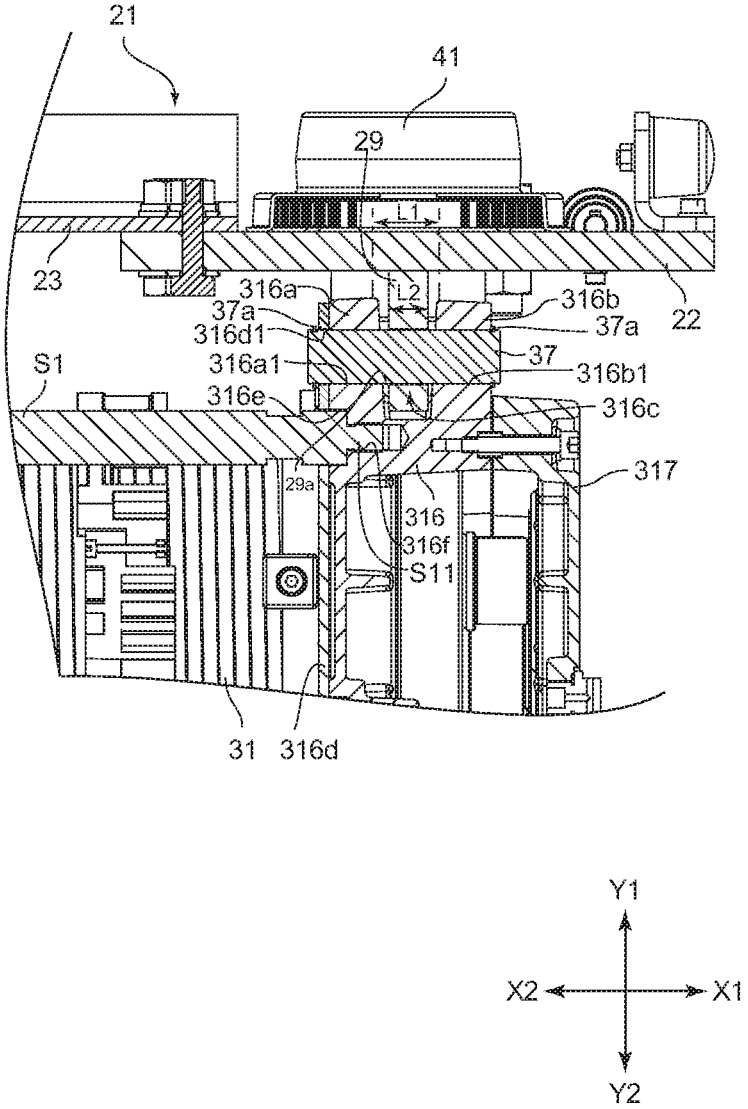
FIG. 13 is a partial cross-sectional view illustrating an attachment form to a drum support frame in the vicinity of a gear body and a gear case in FIG. 3.
Figure 14:
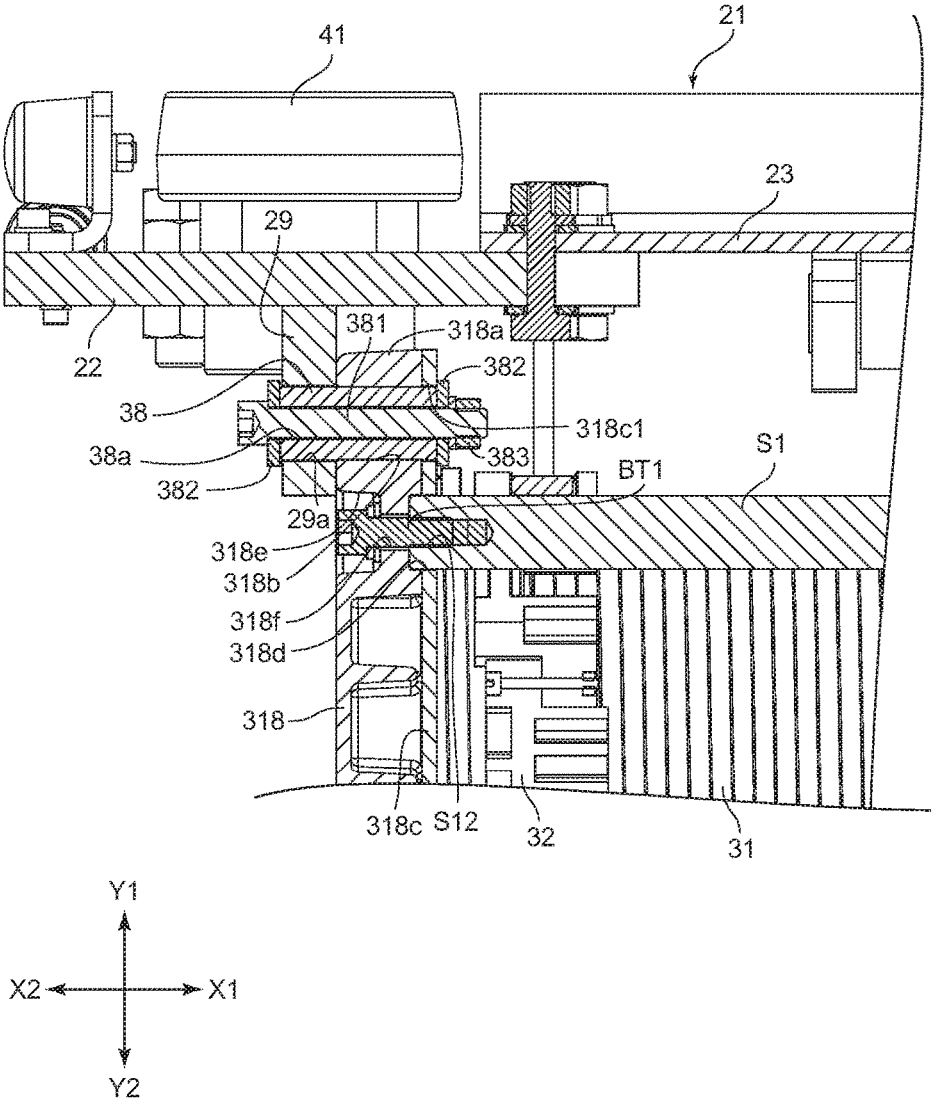
FIG. 14 is a partial cross-sectional view illustrating an attachment form to the drum support frame in the vicinity of a back frame in FIG. 3.

Subsequently, the attachment structure of the rope drum mechanism 30 to the drum support frames 29 will be described. As illustrated in FIG. 3, the rope drum mechanism 30 is attached to the drum support frames 29. The details of the attachment are illustrated in FIG. 13. FIG. 13 is a partial cross-sectional view illustrating an attachment form to the drum support frame 29 in the vicinity of the gear body 316 and the gear case 317 in FIG. 3. FIG. 14 is a partial cross-sectional view illustrating an attachment form to the drum support frame 29 in the vicinity of the back frame 318.

As illustrated in FIG. 13, the rope drum mechanism 30 is attached, on its X1 side, to the drum support frame 29 via the gear body 316. The gear body 316 is provided with a pair of supporting ribs 316*a*, 316*b*. Between the pair of supporting ribs 316*a* and 316*b*, a recessed portion 316*c* for frame is provided for allowing the drum support frame 29 to be located therein. Note that the gear body 316 corresponds to a first support part, and the gear case 317 may be made to correspond, together with the gear body 316, to the first support part.

As is clear from FIG. 13, here, a dimension L1, in the X-direction, of the recessed portion 316*c* for frame is provided to be larger by a predetermined dimension than a width L2 of the drum support frame 29. Therefore, when the drum support frame 29 is disposed in the recessed portion 316*c* for frame, predetermined clearances are provided to the both surface sides of the drum support frame 29 with respect to the pair of supporting ribs 316*a*, 316*b*. Note that regarding the clearances, members filling gaps such as spacers or the like are not attached to a later-described connection pin 37. Therefore, the variation in dimension on the frame structure 20 side and the vibration from the frame structure 20 side can also be absorbed by using the clearances.

Further, the pair of supporting ribs 316*a*, 316*b* are provided with through holes 316*a*1, 316*b*1 penetrating the supporting ribs 316*a*, 316*b* in the X-direction, respectively. Further, the drum support frame 29 is also provided with a through hole 29*a* having almost the same diameter as those of the through holes 316*a*1, 316*b*1. To these through holes 316*a*1, 316*b*1 and to the through hole 29*a*, the connection pin 37 (corresponding to a first connection member) provided in a shaft shape is inserted. The connection pin 37 has sufficient shear strength, and the X1 side of the rope drum mechanism 30 is supported by the drum support frame 29 via the connection pin 37.

As described above, the rope drum mechanism 30 is supported via the connection pin 37 in a state where the drum support frame 29 is located between the pair of supporting ribs 316*a* and 316*b*. On one end side (X1 side) of the rope drum mechanism 30, the support of the rope drum mechanism 30, a so-called both-end support to hold the drum support frame 29 from both sides is realized. In the both-end support, the clearances can be formed between the drum support frame 29 and the pair of supporting ribs 316*a*, 316*b*. An error in manufacturing the rope hoist 10 and an assembly error in assembling the rope drum mechanism 30 and the frame structure 20 can be absorbed by the clearances.

Note that on both end sides of the connection pin 37, snap rings 37*a* (corresponding to coming-off preventing members) are attached from its outer peripheral sides. This prevents the connection pin 37 from coming off the through holes 316*a*1, 316*b*1 and off the through hole 29*a*. Note that the connection pin 37 and the snap rings 37*a* correspond to the first connection member.

Further, to the gear body 316, an end plate 316*d* is attached, and the end plate 316*d* is also provided with an insertion hole 316*d*1 for allowing the connection pin 37 to be inserted thereinto. The snap rings 37*a* are attached to an end portion of the connection pin 37 in a state where the snap rings 37*a* are in contact with the end plate 316*d*.

Further, one end side (X1 side) of the support shaft S1 is attached to the gear body 316 as in the following manner. More specifically, the support shaft S1 is attached not on the same axis with the connection pin 37 but at a position on the gear body 316 different from that of the connection pin 37. In the configuration illustrated in FIG. 13, the support shaft S1 is attached to the gear body 316 on a side closer to the Y2 side than is the connection pin 37.

To enable such attachment of the support shaft S1, a shaft supporting recessed portion 316*e* is provided on a side closer to the Y2 side than are the pair of supporting ribs 316*a*, 316*b* of the gear body 316. Further, a female thread part 316*f* is provided on a side closer to the X1 side than is the shaft supporting recessed portion 316*e*. On the other hand, the support shaft S1 is provided with a male thread part S11 having a diameter smaller than that of the other portion of the support shaft S1. Therefore, by locating the one end side of the support shaft S1 in the shaft supporting recessed portion 316*e* and screwing the male thread part S11 into the female thread part 316*f*, the support shaft S1 is supported by the gear body 316.

Subsequently, the attachment to the drum support frame 29 in the vicinity of the back frame 318 will be described. Note that the back frame 318 corresponds to a second support part. As illustrated in FIG. 14, at a site, of the back frame 318, closer to the support frame 22, a frame attachment portion 318*a* is provided. The frame attachment portion 318*a* is a portion provided to be thicker than the other portion of the back frame 318, and the frame attachment portion 318*a* is fixed to the drum support frame 29.

The frame attachment portion 318*a* is provided with an insertion hole 318*b* penetrating the frame attachment portion 318*a* in the X-direction. The drum support frame 29 is also provided with a through hole 29*a* having a diameter equal to that of the above-described insertion hole 318*b*. Into the insertion hole 318*b* and into the through hole 29*a*, a connection cylinder 38 is inserted. The connection cylinder 38 is provided in a cylindrical shape having a cylinder hole 38*a* as illustrated in FIG. 14. In the cylinder hole 38*a*, a coupling bolt 381 is inserted with a washer 382 or the like intervening therebetween. Note that the connection cylinder 38 and the coupling bolt 381 correspond to a second connection member. The connection cylinder 38 and the coupling bolt 381 are arranged on the same axis as the connection pin 37.

In the configuration illustrated in FIG. 14, the coupling bolt 381 is inserted into the cylinder hole 38*a* from the X2 side and projects to the X1 side of the cylinder hole 38*a*. Further, at a site where the coupling bolt 381 projects from the cylinder hole 38*a*, a nut 383 is screwed to the coupling bolt 381. This firmly fastens the back frame 318 to the drum support frame 29. The back frame 318 side is fixed to the drum support frame 29 as described above, whereby the back frame 318 side can be used as a reference for positioning when the rope drum mechanism 30 is attached.

Note that to the back frame 318, an end plate 318*c* is also attached, and the end plate 318*c* is also provided with an insertion hole 318*c*1 for allowing the connection cylinder 38 to be inserted thereinto. The nut 383 is attached to an end portion of the connection pin 37 in a state where the nut 383 is in contact with the end plate 318*c*.

Next, the attachment of the other end side (X2 side) of the support shaft S1 will be described. As with the above-described attachment of the one end side (X1 side) of the support shaft S1, the support shaft S1 is attached not on the same axis with the connection cylinder 38 but at a position on the back frame 318 different from that of the connection cylinder 38. Specifically, as illustrated in FIG. 14, the support shaft S1 is attached to the back frame 318 on a side closer to the Y2 side than is the connection cylinder 38.

To enable such attachment, of the support shaft S1, on the other end side (X2 side), a shaft supporting recessed portion 318*d* is provided on a side closer to the Y2 side than is the frame attachment portion 318*a*. The other end side (X2 side) of the support shaft Si can be located in the shaft supporting recessed portion 318*d*.

Further, on the same axis with the shaft supporting recessed portion 318*d*, an attaching recessed portion 318*e* and a communication hole 318*f* are provided. The attaching recessed portion 318*e* is a portion where the head of an attaching bolt BT1 is located, and the communication hole 318*f* is a hole portion for allowing a thread portion of the attaching bolt BT1 to be inserted thereinto. On the other hand, at the other end side (X2 side) of the support shaft S1, a female thread part S12 in a hole shape is provided. Therefore, by screwing the attaching bolt BT1 into the female thread part S12 via the attaching recessed portion 318*e* and the communication hole 318*f*, the support shaft S1 is fixed to the back frame 318.

<6. Regarding the Trolley Mechanism 40>

Next, the trolley mechanism 40 will be described. As illustrated in FIG. 1 to FIG. 6 and so on, the rope hoist 10 has the trolley mechanism 40. The trolley mechanism 40 has the wheels 41 attached to the support frames 22 of the frame structure 20, the traversing motor 42, gear mechanism parts 43, 44, a drive shaft 45, and guide rollers 46. Note that the frame structure 20 may also be the one constituting the trolley mechanism 40. Two wheels 41 are provided each on one side and the other side of the rails R (four in total). The wheels 41 are mounted on flange parts R1 of the rails R.

As illustrated in FIG. 7, to the support frame 22 located on the one side (Y1 side) in the width direction, the traversing motor 42 that generates driving force is attached. The traversing motor 42 applies the driving force to the two wheels 41 located on the one side (X1 side) in the longitudinal direction (X-direction). In more detail, the driving force from the output shaft of the traversing motor 42 is transmitted to the drive shaft 45 through a gear train (not illustrated) located inside the gear mechanism part 43.

The drive shaft 45 is provided along the width direction (Y-direction), and its other end side (Y2 side) in the width direction (Y-direction) is connected to the gear mechanism part 44. Also inside the gear mechanism part 44, a gear train (not illustrated) is provided, and the driving force is applied through the gear train to the wheels 41 on the other end side (Y2 side). Thus, the two wheels 41 are synchronously rotated to enable stable traveling of the rope hoist 10.

Note that to the support frames 22, the guide rollers 46 are attached, respectively. When the traversing motor 42 is driven to move the rope hoist 10 along the rails R, the rope hoist 10 meanders in some cases. To prevent such meandering, the guide rollers 46 are provided in the vicinity of the respective wheels 41, and the guide rollers 46 are in contact with the flange parts R1 of the rails R. This stabilizes the traveling of the rope hoist 10. The guide rollers 46 are located on a slightly lower side than are the wheels 41 so as to come into contact with the flange parts R1, and are provided on an outer side in the longitudinal direction (X-direction) than are the wheels 41.

<7. Regarding the Intermediate Sheave Body 50>

Figure 15:
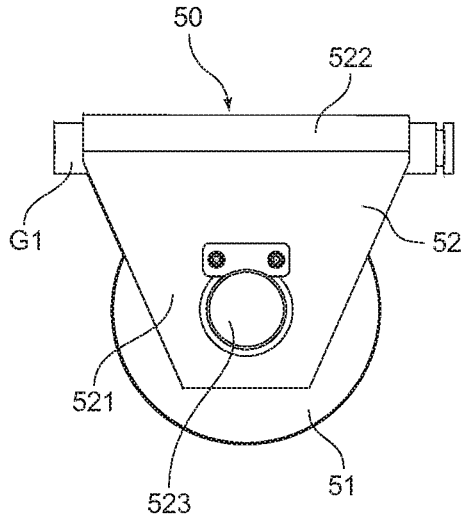
FIG. 15 is a view illustrating an intermediate sheave body in the rope hoist in FIG. 1 as viewed from the side.

Next, the intermediate sheave body 50 will be described. As illustrated in FIG. 3 and FIG. 6, the intermediate sheave body 50 is provided on a side closer to the rear (X2 side) than is the traversing motor 42. FIG. 15 is a view illustrating a state of the intermediate sheave body 50 as viewed from the side. Besides, FIG. 16 is a front cross-sectional view illustrating the configuration of the intermediate sheave body 50.

As illustrated in FIG. 15, the intermediate sheave body 50 includes an intermediate sheave 51 (pulley) around which the wire rope W is to be wound, and the intermediate sheave 51 has a recessed groove 51*b* surrounded by a flange 51*a*. Further, the intermediate sheave 51 is arranged in a direction to be parallel with the rails R. The intermediate sheave body 50 enables relay of the wire rope W between adjacent hook sheaves 71 (refer to FIG. 18) of the later-described hook block 70. The intermediate sheave body 50 is attached to the suspender shaft G1. The intermediate sheave body 50 includes a suspending metal fitting 52, and the suspending metal fitting 52 is supported on the suspender shaft G1.

Figure 16:
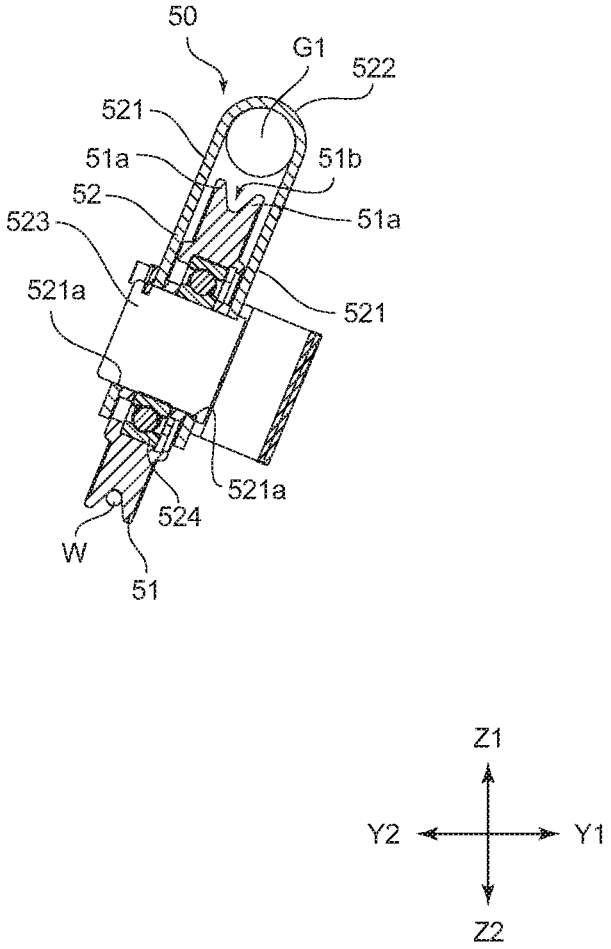
FIG. 16 is a front cross-sectional view illustrating the configuration of the intermediate sheave body in the rope hoist in FIG. 1.

As illustrated in FIG. 15 and FIG. 16, the suspending metal fitting 52 has a pair of plate portions 521 facing each other, and a coupling portion 522 that couples the pair of plate portions 521 is provided on both end sides and on an upper side of the plate portions 521. As illustrated in FIG. 16, the coupling portion 522 is provided in a shape curved to surround the suspender shaft G1, and the coupling portion 522 swings (turns) in contact with the suspender shaft G1 and thereby enables the intermediate sheave body 50 to swing (turn over).

Between the pair of plate portions 521, the intermediate sheave 51 is rotatably supported. More specifically, the pair of plate portions 521 are provided with shaft support holes 521*a* respectively, and to the shaft support holes 521*a*, a support shaft 523 is attached. On the outer peripheral side of the support shaft 523 and between the pair of plate portions 521, a bearing 524 as a shaft bearing is attached. To the outer peripheral side of the bearing 524, the intermediate sheave 51 is attached. Thus, the intermediate sheave 51 is provided rotatably with respect to the plate portions 521.

<8. Regarding the Rope Fixing Member 60>

Figure 17:
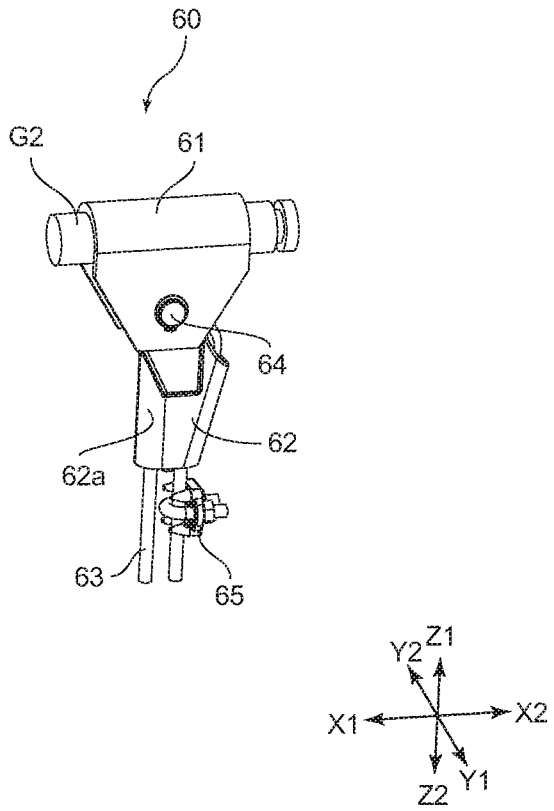
FIG. 17 is an exploded perspective view illustrating the configuration of a rope fixing member in the rope hoist in FIG. 1.

Besides, as illustrated in FIG. 1 to FIG. 4 and so on, to retain the one end side of the wire rope W, the rope fixing member 60 is provided. The rope fixing member 60 is attached to the above-described terminal support shaft G2. FIG. 17 is a side view illustrating the configuration of the rope fixing member 60. As illustrated in FIG. 17, the rope fixing member 60 has a horizontal turn metal fitting 61, a vertical turn metal fitting 62, and a bent metal fitting 63 as main components.

The horizontal turn metal fitting 61 having a front shape in an almost U-shape is in contact with the terminal support shaft G2 to be swingable in a YZ plane. Further, to the horizontal turn metal fitting 61, the vertical turn metal fitting 62 is turnably attached via a fixing shaft 64. On a lower side of the vertical turn metal fitting 62, a rope retaining portion 62*a* is provided. The rope retaining portion 62*a* is provided such that the upper side and the lower side of a quadrangular pyramid columnar shape are opened to allow the wire rope W and a not-illustrated wedge member to be inserted thereinto from the upper side and from the lower side. Further, the rope retaining portion 62*a* is provided such that its cross-sectional area becomes smaller as it goes downward.

Inside the rope retaining portion 62*a*, the bent metal fitting 63 made by bending a steel bar and the not-illustrated wedge member are arranged, and the wire rope W is to be arranged on the outer peripheral side of the bent metal fitting 63. Therefore, when the bent metal fitting 63 and the not-illustrated wedge member try to move downward by a load acting on the wire rope W, the wire rope W is sandwiched between the bent metal fitting 63 and the inner wall of the rope retaining portion 62*a* by large holding force. This restricts downward movement of the wire rope W.

Note that the most terminal side of the wire rope W is fixed, below the rope retaining portion 62*a*, to the bent metal fitting 63 by a fixing metal fitting 65.

<9. Regarding the Hook Block 70>

Figure 18:
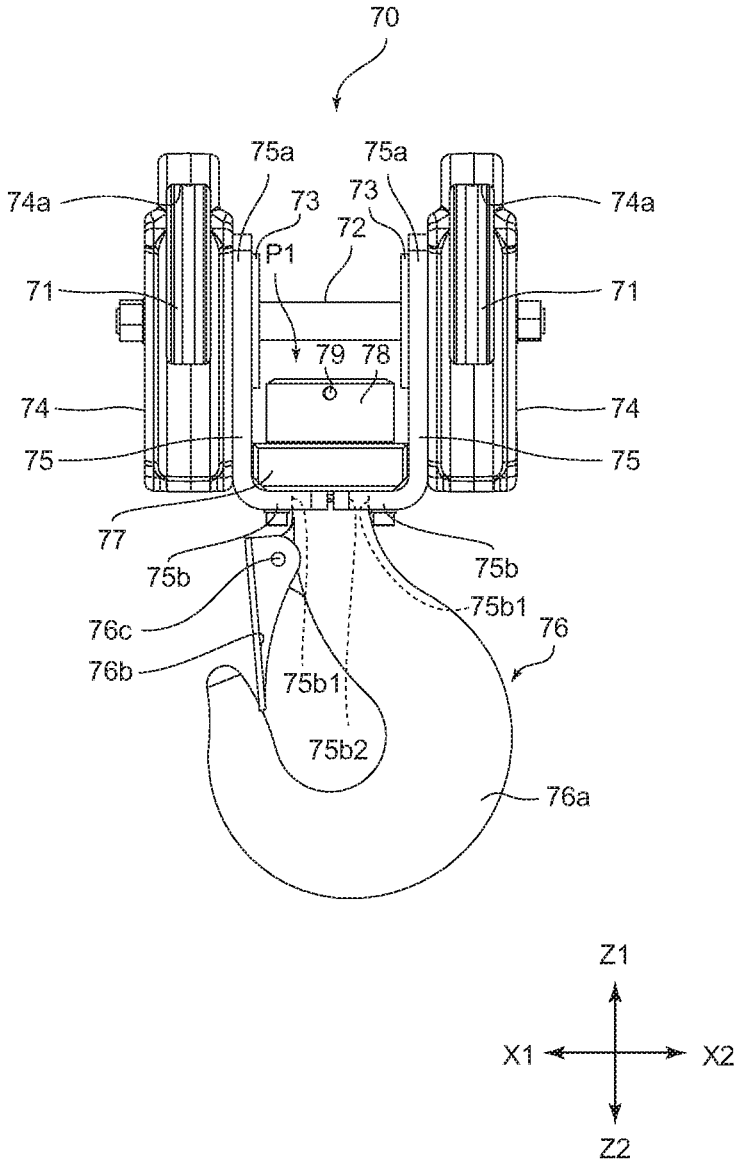
FIG. 18 is a side view illustrating the configuration of a hook block in the rope hoist in FIG. 1.

FIG. 18 is a side view illustrating the configuration of the hook block 70. As illustrated in FIG. 18, the hook block 70 includes a pair of hook sheaves 71, and the hook sheaves 71 are attached, via not-illustrated shaft bearings, to sheave shaft parts 73 attached to a coupling shaft 72.

The sheave shaft part 73 is inserted into a not-illustrated hole portion of a bracket 75 and thereby supports the bracket 75. Further, inside a cover 74, a not-illustrated shaft bearing is attached to the outer peripheral side of the sheave shaft part 73, and the hook sheave 71 is attached via the shaft bearing. Thus, the hook sheave 71 is supported to be rotatable with respect to the coupling shaft 72.

The hook sheave 71 is a pulley around which the wire rope W is to be wound, and the most part on the outer peripheral side of the hook sheave 71 is covered with the cover 74 for preventing involvement of a foreign substance. Note that the cover 74 is provided with an opening portion 74*a* for leading the wire rope W out as illustrated in FIG. 14.

To support the above-described sheave shaft parts 73, a pair of brackets 75 are provided. In the configuration illustrated in FIG. 18, the bracket 75 is provided having an external appearance in an almost L-shape. A long piece portion 75*a* of the L-shape is provided with the hole portion for allowing the above-described sheave shaft part 73 to be inserted thereinto. Further, a short piece portion 75*b* orthogonal to the long piece portion 75*a* is arranged in a state of facing the short piece portion 75*b* of the other bracket 75. Thus, a housing space part P1 is formed which is surrounded by the long piece portions 75*a* and the short piece portions 75*b*.

Further, on tip end sides facing each other of the short piece portions 75*b*, hemicycle opening portion 75*b*1 is provided, and two opening portions 75*b*1 face each other to form an insertion hole 75*b*2 into which a not-illustrated pivotal support part of a hook 76 is inserted.

In the above-described housing space part P1, a hook receiving part 77 is arranged, and a support nut 78 is arranged on the upper portion of the hook receiving part 77 via a not-illustrated shaft bearing such as a thrust bearing. The hook receiving part 77 is provided with an insertion hole for allowing the pivotal support part (not illustrated) of the hook 76 to be inserted thereinto. Further, the support nut 78 is formed with a threaded hole, and a male thread part formed on the outer periphery of the pivotal support part of the hook 76 is screwed into the threaded hole. The support nut 78 and the hook 76 are provided with, on the upper side, communication holes communicating each other, and a locking pin 79 is inserted into the communication holes. Thus, the hook 76 is supported by the support nut 78, and the support nut 78 and the hook 76 are provided to be turnable with respect to the hook receiving part 77.

The hook 76 is provided with a hook main body portion 76*a*. The hook main body portion 76*a* is a portion on which a cargo is hooked, and has an external appearance in a hook shape. To the hook main body portion 76*a*, a lever 76*b* for preventing the hooked cargo from coming off is attached. The lever 76*b* has one end side located on the upper side (Z1 side) and provided to be turnable with a turn shaft 76*c* on the one end side as a supporting point. Further, the other end side of the lever 76*b* is located on the lower side (Z2 side) and provided to be in contact with the inner periphery on the tip end side of the hook main body portion 76*a*. The lever 76*b* is provided such that biasing force by a not-illustrated spring acts thereon to cause its other end side to be in contact with the inner periphery on the tip end side of the lever 76*b* at all times. This makes it possible, in a state where no external force acts on the lever 76*b*, to maintain the closed state of the lever 76*b*, thereby preventing the cargo from dropping because the lever 76*b* is opened.

<10. Regarding the Counterweight 80>

Subsequently, the counterweight 80 will be described. As illustrated in FIG. 1 to FIG. 7, the rope hoist 10 is provided with the counterweight 80. The counterweight 80 is provided to achieve a balance in the width direction (Y-direction) of the rope hoist 10. More specifically, the rope drum mechanism 30 composed of many components is provided on the other end side (Y2 side) in the width direction (Y-direction) of the rope hoist 10, and has a relatively large weight. To achieve a weight balance with the rope drum mechanism 30, the counterweight 80 formed, for example, from a thick steel sheet or the like is coupled to the one end sides (Y1 side) in the width direction (Y-direction) of the coupling bars 24.

<11. Regarding the Control Unit 90>

Subsequently, the control unit 90 will be described. The control unit 90 is a part that controls drive of the rope hoist 10 including the drum motor 33, the traversing motor 42 and so on. Therefore, in the control unit 90, a control device for executing the control of them is arranged. Note that examples of the control device include a main control unit, a motor driver, a power supply and so on that administer control of the whole, and they are covered by a cover member 91. The control unit 90 is also provided with a braking circuit for performing control when passing current through the braking resistor 100. The control unit 90 is fixed to a surface on the one side (Y1 side) of the counterweight 80 via a screw or the like. As the main control unit and the motor driver, a hoist inverter control device (not illustrated) and a traversing device inverter control device (not illustrated) are used.

<12. Regarding the Braking Resistor 100>

Subsequently, the braking resistor 100 will be described. The braking resistor 100 illustrated in FIG. 1 to FIG. 7 corresponds to a braking resistor part and is provided to process the regenerative electric power generated when the drum motor 33 is operated to rolling down operation, and can control the current flowing through the braking resistor part by the hoist inverter control device to exhibit the regenerative braking ability. The braking resistor 100 includes a resistor element (not illustrated), and passes electric energy, which is returned from the drum motor 33, through the resistor element to thereby convert the electric energy to heat and radiate the heat. In addition to the above, the braking resistor 100 may be used to process also the regenerative electric power of the traversing motor 42.

Note that as the resistor element of the braking resistor 100, any resistor element may be used as long as it can cope with large current, such as an enamel resistor, a cement resistor or the like.

<13. Regarding the Direct-Acting Switch Mechanism 110>

Next, the direct-acting switch mechanism 110 will be described. As illustrated in FIG. 3, FIG. 7 and so on, the rope hoist 10 has the direct-acting switch mechanism 110. The direct-acting switch mechanism 110 is configured to detect the rising limit of the hook block 70, by coming into direct contact with the hook block 70 when the hook block 70 is raised. When the direct-acting switch mechanism 110 detects the rising limit of the hook block 70, a detection signal is transmitted to the control unit 90, and the control unit 90 stops the operation of the drum motor 33 on the basis of the detection signal.

Note that the rising limit of the hook block 70 can be basically detected by switching between ON and OFF of the limit switch mechanism 35*b* as described above. However, if the limit switch mechanism 35*b* does not satisfactorily operate due to some reasons, the direct-acting switch mechanism 110 directly detects the rising of the hook block 70. This prevents the hook block 70 from excessively rising. A so-called double detecting mechanism such as the limit switch mechanism 35*b* and the direct-acting switch mechanism 110 is provided for the rising limit of the hook block 70.

Figure 19:
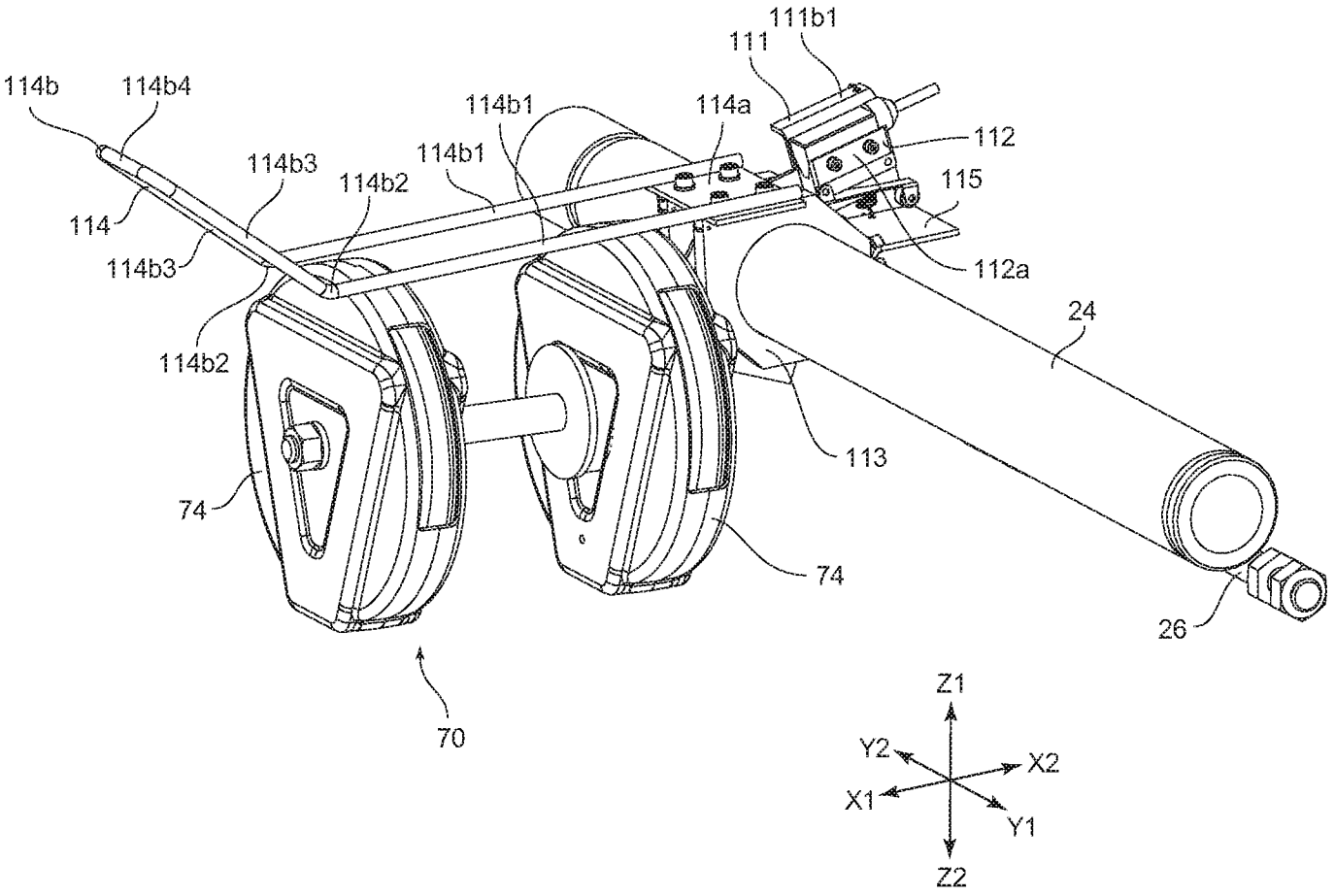
FIG. 19 is a perspective view illustrating the configuration of a direct-acting switch mechanism in the rope hoist in FIG. 1, being a view illustrating a state where the direct-acting switch mechanism is attached to a coupling bar and illustrating an image at a time when the hook block is detected by a detection lever.
Figure 20:
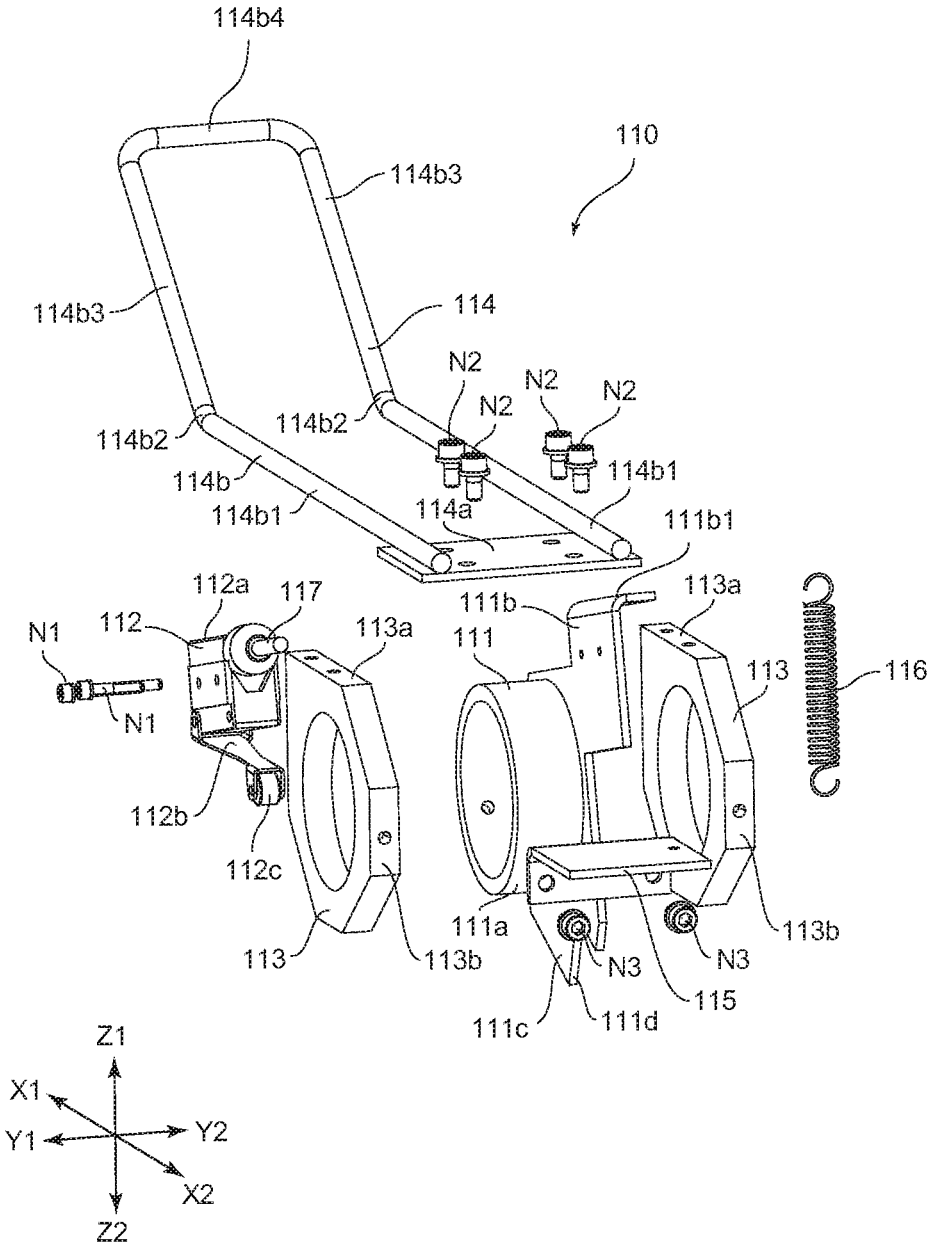
FIG. 20 is an exploded perspective view illustrating the configuration of the direct-acting switch mechanism in the rope hoist in FIG. 1.

FIG. 19 is a perspective view illustrating the configuration of the direct-acting switch mechanism 110, being a view illustrating a state where the direct-acting switch mechanism 110 is attached to the coupling bar 24 and illustrating an image at the time when the hook block 70 is detected by a detection lever member 114. FIG. 20 is a exploded perspective view illustrating the configuration of the direct-acting switch mechanism 110.

The direct-acting switch mechanism 110 includes a shaft attachment metal fitting 111, a limit switch main body part 112, a pair of turn rings 113, the detection lever member 114, a pressing plate 115, and a biasing spring 116.

As illustrated in FIG. 20, the shaft attachment metal fitting 111 includes a ring-shaped portion 111*a*, an attachment plate portion 111*b*, and a position restraining plate portion 111*c*. The ring-shaped portion 111*a* of them is a portion in a ring shape attached to the coupling bar 24, and is fixed to the coupling bar 24, for example, via a setscrew or the like. Besides, the attachment plate portion 111*b* extends to separate from the ring-shaped portion 111*a* in diameter direction and is additionally located on the side upper than is the coupling bar 24. To the attachment plate portion 111*b*, the later-described limit switch main body part 112 is attached, for example, via screws N1 and the like. Further, on the upper side of 111*b*, a spring attachment portion 111*b*1 is also provided, and one end side of the later-described biasing spring 116 is locked to the spring attachment portion 111*b*1.

The position restraining plate portion 111*c* is a portion locked to the coupling assist bar 26, and the position restraining plate portion 111*c* is provided with a locking cutout portion 111*d* to realize such locking. The locking cutout portion 111*d* is provided such that the above-described coupling assist bar 26 fits thereinto. More specifically, if the setscrew loosens, the hook block 70 rises to bump against the detection lever member 114, and when the hook block 70 further rises, the shaft attachment metal fitting 111 and the shaft attachment metal fitting 111 also come to turn accompanying the rise. However, in the case where the coupling assist bar 26 is arranged to fit into the locking cutout portion 111*d*, the position restraining plate portion 111*c* bumps against the coupling assist bar 26. This ensures that even if the setscrew loosens, switching between ON and OFF of the limit switch main body part 112 can be achieved, thereby stopping the operation of the drum motor 33. This makes it possible to stop the rising of the hook block 70.

Further, the limit switch main body part 112 includes, as with the above-described limit switch main body part 351, a main body portion 112*a* in a box shape in which a not-illustrated switch mechanism capable of switching between ON and OFF is attached, and a cable 117 is electrically connected to the switch mechanism. The limit switch main body part 112 also includes a switch lever 112*b*, and the switch lever 112*b* is turnably attached to the main body portion 112*a*. The switch lever 112*b* is also configured to be able to push in a switch (not illustrated) that can enter and exit the main body portion 112*b*. Therefore, the switch mechanism is configured to be switched between ON and OFF depending on whether the switch lever 112*b* turns to push in the switch or not.

On the tip end side of the switch lever 112*b*, a roller 112*c* is turnably attached, and the roller 112*c* can come into contact with the pressing plate 115. The turning amount of the switch lever 112*b* changes depending on whether or not the roller 112*c* pushes in the pressing plate 115, thereby switching between ON and OFF of the switch mechanism.

This enables the direct-acting switch mechanism 110 to detect whether or not the hook block 70 has reached the rising limit.

The turn rings 113 are attached in a state of being turnable with respect to the coupling bar 24. The turn rings 113 are provided to both sides of the shaft attachment metal fitting 111 in the Y-direction. More specifically, the shaft attachment metal fitting 111 is sandwiched between the pair of turn rings 113. The turn rings 113 are each provided in a polygonal shape so as to allow other members to be easily attached thereto. Specifically, a flat attachment surface 113*a* is provided on the upper side of the turn ring 113, and a lever attachment portion 114*a* of the detection lever member 114 is attached to the attachment surface 113*a* via screws N2.

Further, on the X2 side of the turn ring 113, an attachment surface 113*b* is similarly provided, and the pressing plate 115 is attached to the attachment surface 113*b* via a screw N3.

Further, the detection lever member 114 includes the lever attachment portion 114*a* and a lever portion 114*b*. The lever attachment portion 114*a* is a plate-shaped portion, and is fixed to the above-described attachment surfaces 113*a* via the screws N2. In this case, the detection lever member 114 is provided to extend from the rear side (X2 side) to the front side (X1 side). In addition, the detection lever member 114 is located between the pair of front-rear frames 21, for example, as illustrated in FIG. 3, FIG. 7 and so on.

In the case of employing the above arrangement, the length of the detection lever member 114 can be increased. Therefore, the detection range in the rising of the hook block 70 can be widened. Further, it is possible to prevent the wire rope W from interfering with the detection lever member 114. Note that the above-described limit switch mechanisms 35*a*, 35*b* and the direct-acting switch mechanism 110 can be arranged so as to draw an almost U-shape, thereby improving the routing property of the cable 117 or the like.

The lever portion 114*b* is a portion formed by bending a steel bar into an almost U-shape. The lever portion 114*b* is a portion turning when the hook block 70 bumps against it, and the lever portion 114*b* therefore has a sufficient length.

Here, the lever portion 114*b* is formed in the following shape. Specifically, the lever portion 114*b* has extending portions 114*b*1 linearly extending from the lever attachment portion 114*a* toward the X1 side and reaching bent portions 114*b*2. Note that the extending portion 114*b*1 is provided in a manner to lower as it goes from the X2 side toward the X1 side at all times regardless of whether or not the hook block 70 bumps against it.

Further, the lever portions 114*b* have tip extending portions 114*b*3 extending from the bent portions 114*b*2 toward the tip end side. The tip extending portion 114*b*3 is provided, when it extends from the bent portion 114*b*2 toward the X1 side, in a manner to go upward at all times regardless of whether or not the hook block 70 bumps against it. Further, on the tip end side of the tip extending portion 114*b*3, a bridge portion 114*b*4 which couples two tip extending portions 114*b*3 is provided.

Note that, as is clear from FIG. 19, the extending portions 114*b*1 are provided to be sufficiently longer than the tip extending portions 114*b*3. Therefore, in the state where the hook block 70 reaches the rising limit as illustrated in FIG. 19, the tip extending portions 114*b*3 can be inclined upward at a steeper angle than that of the extending portions 114*b*1. Even in the case where the hook block 70 is located below, the tip extending portions 114*b*3 can be arranged not to lower but to rise as they go from the bent portions 114*b*2 toward the tips.

Further, the pressing plate 115 is attached to the above-described attachment surfaces 113*b* via the screws N3. The pressing plate 115 is provided to project to the rear side (X2 side). The pressing plate 115 is a portion against which the roller 112*c* of the limit switch main body part 112 is pressed when the hook block 70 bumps against the detection lever member 114 and reaches the rising limit.

Further, the biasing spring 116 is a spring that is attached between the shaft attachment metal fitting 111 and the pressing plate 115 and applies tensile force to both of them. In more detail, one end side of the biasing spring 116 is locked to the spring attachment portion 111*b*1 of the shaft attachment metal fitting 111 incapable of turning, the shaft attachment metal fitting 111 being fixed to the coupling bar 24 with the setscrew. Further, the other end side of the biasing spring 116 is locked to the pressing plate 115 fixed to the turn rings 113 capable of freely turning with respect to the coupling bar 24. Therefore, the biasing spring 116 applies tensile force of rising the pressing plate 115. This tensile force applies force in a direction of lowering to the detection lever member 114 side in a state where the hook block 70 is not in contact with the detection lever member 114.

Note that the turning of the detection lever member 114 downward is described, for example, by the lever attachment portion 114*a* coming into contact with a predetermined site of the shaft attachment metal fitting 111.

<14. Operation and Effect>

In the rope hoist 10 in the above configuration, the rope drum mechanism 30 is provided with the gear body 316 which rotatably supports the rope drum 31 on the one end side (X1 side) in the axial direction (X-direction) and provided with the back frame 318 which rotatably supports the rope drum 31 on the one end side (X1 side) in the axial direction (X-direction). The gear body 316 of them is provided with the pair of supporting ribs 316*a*, 316*b*, and the recessed portion 316*c* for frame exists between the supporting ribs 316*a* and 316*b*. In the recessed portion 316*c* for frame, the drum support frame 29 is located, and the drum support frame 29 is held between the pair of supporting ribs 316*a* and 316*b*.

The connection pin 37 penetrates the pair of supporting ribs 316*a*, 316*b* and the drum support frame 29, whereby the pair of supporting ribs 316*a*, 316*b* mechanically connect, in a state of both-end support, the gear body 316 side to the drum support frame 29.

Further, the back frame 318 is provided with the frame attachment portion 318*a*, and the frame attachment portion 318*a* comes, at least a part thereof, into surface contact with the drum support frame 29, and then the connection cylinder 38 and the coupling bolt 381 penetrate them, whereby the frame attachment portion 318*a* mechanically connects, in a state of cantilever, the back frame 318 side to the drum support frame 29.

Such a configuration is employed to support, in the state of both-end support, the gear body 316 to which the drum motor 33 and the reduction mechanism 34 are attached and on which a large load therefore acts, and can thereby stably support the side where large load acts.

Besides, the other end side (X2 side) of the rope drum 31 is supported in the state of cantilever, and in this cantilever support, the frame attachment portion 318*a* and the drum support frame 29 are fastened together using the coupling bolt 381 and the nut 383. Therefore, the frame attachment portion 318*a* on the cantilever support side can be used as a clear reference for positioning when assembling the rope drum mechanism 30. Further, the number of parts can be reduced by employing the cantilever support on the other end side (X2 side) of the rope drum 31 as compared with the case of the both-end support on both sides of the rope drum 31.

Besides, between the pair of supporting ribs 316*a*, 316*b* and the drum support frame 29, clearances exist without spacers or the like intervening therebetween, and the rope drum mechanism 30 is supported via the connection pin 37 in the state where the clearances exist. Therefore, the clearances can be used to absorb the error when welding the drum support frame 29 to the support frame 22, the error at the manufacturing stage before assembly such as the error in manufacturing casting components, and the error in assembling the rope drum mechanism 30 and the frame structure 20. Further, the vibration from the frame structure 20 side can also be absorbed by the clearances.

Besides, in this embodiment, the support shaft 51 is arranged on the axis different from those of the connection pin 37, the connection cylinder 38, and the coupling bolt 381. More specifically, the attachment site of the gear body 316 with respect to the drum support frame 29 on the one end side (X1 side) and the attachment site of the back frame 318 with respect to the drum support frame 29 on the other end side (X2 side) do not exist on the same axis with respect to the support shaft S1. Therefore, it becomes possible to make the rope drum mechanism 30 into one unit and independently assemble the rope drum mechanism 30, and to store the rope drum mechanism 30 in a state of being made into one unit. In the case of assembling the rope hoist 10, the rope drum mechanism 30 can be easily attached by connecting the rope drum mechanism 30 to the drum support frames 29. Accordingly, the manufacturing efficiency can be improved.

Further, even in the case of detaching the rope drum mechanism 30 from the state of being attached to the drum support frames 29, the rope drum mechanism 30 is never fallen to pieces. Accordingly, at the time when detaching the rope drum mechanism 30 from the drum support frames 29 and performing maintenance thereon, the work of assembling the rope drum mechanism 30 again can be eliminated to facilitate the maintenance.

Further, in this embodiment, the second connection member includes the cylindrical connection cylinder 38, and the coupling bolt 381 to be inserted to the connection cylinder 38, and the coupling bolt 381 is fastened with the nut 383. On the other hand, the first connection member includes the columnar or cylindrical connection pin 37, and the snap rings 37*a* at projecting portions of the connection pin 37 projecting from the through holes 316*a*1, 316*b*1 of the pair of supporting ribs 316*a*, 316*b*, the snap rings 37*a* preventing coming-off of the connection pin 37. Therefore, the following effects can be provided.

More specifically, if the pair of supporting ribs 316*a*, 316*b* sides are also fastened with bolts or the like such as the coupling bolt 381, looseness may occur in fastening of the bolts. In more detail, in the case of hanging a heavy cargo, dimensional variability such as deflection, expansion and contraction or the like occurs in the frame structure 20. Such dimensional variability is transmitted also to the rope drum mechanism 30 side. In this event, if the pair of supporting ribs 316*a*, 316*b* sides are fastened with bolts or the like, the influence of the dimensional variability is exerted also on the bolts and the coupling bolt 381 on the other end side (X2 side). This may cause looseness in the bolts on the one end side (X1 side) and the coupling bolt 381 on the other end side (X2 side) in long-term use.

However, in this embodiment, only the back frame 318 side is configured to be fastened with the coupling bolt 381. And, on the gear body 316 side in the both-end support, without employing the fastening with bolts, the configuration of preventing coming-off of the connection pin 37 by the snap rings 37*a* is employed. Therefore, even if the above-described dimensional variability occurs, its influence can be absorbed, thereby making it possible to make the coupling bolt 381 on the back frame 318 side difficult to loosen.

Further, in this embodiment, the connection pin 37 is arranged on the same axis with the connection cylinder 38 and the coupling bolt 381. Therefore, it becomes possible to use the same member for the drum support frame 29 on the front side (X1 side) and for the drum support frame 29 on the other side (X2 side).

<15. Modification Examples>

The embodiment of the present invention has been described, and the present invention is variously modified in addition to the embodiment. Hereinafter, modifications will be described.

The above-described embodiment has the configuration in which the gear body 316 side is in the both-end support with respect to the drum support frame 29, and the back frame 318 side is in the cantilever support with respect to the drum support frame 29. However, a configuration may be employed in which the back frame 318 side is in the both-end support with respect to the drum support frame 29, and the gear body 316 side is in the cantilever support with respect to the drum support frame 29.

Further, the coupling bolt 381 is a standard bolt in the above-described embodiment, but a bolt with high positioning accuracy such as a reamer bolt may be used.

Further, in the above-described embodiment, the rope hoist 10 including the trolley mechanism 40 having the traversing motor 42 is described. However, the present invention may be applied to a rope hoist including a manual type trolley mechanism without including the traversing motor 42.

Further, the rope hoist 10 in the above embodiment is a so-called 4/1 reeving type in which one end of the wire rope W is fixed to the rope drum 31, the other end of the wire rope W is fixed to the rope fixing member 60, and the intermediate sheave body 50 is arranged between them. However, the present invention is applied not only to the 4/1 reeving type. For example, the present invention may be applied to a so-called 2/1 reeving type in which one end of the wire rope W is fixed to the rope drum 31, the other end of the wire rope W is fixed to the rope fixing member 60, but the intermediate sheave body is not used. Further, the present invention may be applied to a so-called 4/2 reeving type in which one end of the wire rope W is fixed to the rope drum 31, the other end of the wire rope W is fixed to the other rope drum (the spiral groove of this rope drum is in an opposite direction to that of the rope drum 31), and the intermediate sheave body 50 is arranged between them.

The invention claimed is:

1. A rope hoist which hoists and lowers a cargo suspended from the rope host via a wire rope by changing a winding length of the wire rope due to rotation of a rope drum, the rope hoist comprising:

a frame structure including a first drum support frame and a second drum support frame which project to the rope drum side, the frame structure supporting parts;

a first support part which rotatably supports the rope drum on one end side in an axial direction of the rope drum;

a second support part which rotatably supports the rope drum on another end side in the axial direction of the rope drum;

a pair of supporting ribs which are provided with the first support part and arranged in a state of having clearances with respect to the first drum support frame and in a state of holding the first drum support frame therebetween;

a first connection member which penetrates the pair of supporting ribs and the first drum support frame and is thereby mechanically connected to the first drum support frame in a state of the pair of supporting ribs being both-end support;

a frame attachment portion which is provided on the second support part and comes, at least a part thereof, into surface contact with the second drum support frame;

a second connection member which penetrates the frame attachment portion and the second drum support frame and is thereby mechanically connected to the second drum support frame in a state of the frame attachment portion being cantilever; and a support shaft which couples the first support part and the second support part and is arranged on an axis passing through a position different from positions of the first connection member and the second connection member.

2. The rope hoist according to claim 1, wherein the first support part is a gear body to which a drum motor configured to apply driving force of rotating the rope drum is attached and which pivotally supports a gear train configured to transmit the driving force of the drum motor to the rope drum.

3. The rope hoist according to claim 1, wherein:

the second connection member includes a cylindrical connection cylinder, and a coupling bolt being inserted to the connection cylinder; and the first connection member includes a columnar or cylindrical connection pin, and coming-off preventing members which prevent coming off of the connection pin at projecting portions of the connection pin projecting from the pair of supporting ribs.

4. The rope hoist according to claim 2, wherein:

the second connection member includes a cylindrical connection cylinder, and a coupling bolt being inserted to the connection cylinder; and the first connection member includes a columnar or cylindrical connection pin, and coming-off preventing members which prevent coming off of the connection pin at projecting portions of the connection pin projecting from the pair of supporting ribs.

5. The rope hoist according to claim 1, wherein the first connection member and the second connection member are arranged on the same axis.

6. The rope hoist according to claim 2, wherein the first connection member and the second connection member are arranged on the same axis.

7. The rope hoist according to claim 3, wherein the first connection member and the second connection member are arranged on the same axis.

8. The rope hoist according to claim 4, wherein the first connection member and the second connection member are arranged on the same axis.

* * * * *